US006433483B1

(12) United States Patent
Michael et al.

(10) Patent No.: US 6,433,483 B1
(45) Date of Patent: Aug. 13, 2002

(54) JEWELLERY ILLUMINATION

(75) Inventors: Peter Colin Michael, Berkshire; Andrew Sean Holmes; Richard Rodney Anthony Syms, both of London, all of (GB)

(73) Assignee: Scintillate Limited, London (GB)

( * ) Notice: Subject to any disclaimer, the term of this patent is extended or adjusted under 35 U.S.C. 154(b) by 0 days.

(21) Appl. No.: 09/554,047

(22) PCT Filed: Nov. 12, 1999

(86) PCT No.: PCT/GB98/03402

§ 371 (c)(1),
(2), (4) Date: May 9, 2000

(87) PCT Pub. No.: WO99/23906

PCT Pub. Date: May 20, 1999

(30) Foreign Application Priority Data

Nov. 12, 1997 (GB) ..... 9723929
Dec. 10, 1997 (GB) ..... 9726165
Jun. 5, 1998 (GB) ..... 9812231

(51) Int. Cl.[7] ..... H01K 7/00

(52) U.S. Cl. ..... 315/76; 315/200 A; 315/291; 315/307; 315/362; 362/104; 362/800; 362/806

(58) Field of Search ..... 315/169.3, 200 A, 315/291, 307, 362, 276, 312, 300, 302, 76; 362/34, 84, 104, 800, 806

(56) References Cited

U.S. PATENT DOCUMENTS 3,938,018 A * 2/1976 Dahl ..... 320/2
3,984,674 A * 10/1976 Guetta ..... 240/6.4 W
4,777,408 A * 10/1988 DeLuca ..... 315/158
4,930,052 A * 5/1990 Beige ..... 362/104
4,973,835 A * 11/1990 Kurosu et al. ..... 250/214 AL
5,323,300 A * 6/1994 McCrary ..... 362/104
5,548,282 A * 8/1996 Escritt et al. ..... 340/825.35
6,016,038 A * 1/2000 Mueller et al. ..... 315/291

FOREIGN PATENT DOCUMENTS

EP 3222349 A1 * 1/1984
EP 19703757 A1 * 8/1998
FR 2585451 * 1/1987
GB 1352835 * 5/1974
GB 1519146 * 7/1978

* cited by examiner

*Primary Examiner*—Haissa Philogene
(74) *Attorney, Agent, or Firm*—Killworth, Gottman, Hagan & Schaeff, L.L.P.

(57) ABSTRACT

An article of jewelry arranged to simulate natural optical effects, such as sparkle and scintillation, is described. The article comprises a jewel, such as a brilliant cut diamond and one or more light sources, such as colored LEDs, incorporated in the article of jewelry for emitting light so as to illuminate the jewel. The article also comprises a microcontroller for driving the one or more LEDs to cause them to emit light pulses of varying intensity thereby simulating said natural optical effects of the jewel. The duration of the light pulses and the location of each light pulse can be varied to enhance the artificial illumination. The article preferably has a cordless rechargeable power supply which avoids the need for unsightly electrical contacts by using an inductive loop charging circuit.

62 Claims, 21 Drawing Sheets

JEWELLERY ILLUMINATION

BACKGROUND OF THE INVENTION

The present invention concerns improvements relating to jewelry illumination, and more particularly, though not exclusively, relates to improvements concerning an article of jewelry including a jewel and having a light source incorporated in the article for illuminating the jewel.

A jewel stone is an optical system that is manufactured from material that is not opaque to light. It may be a natural mineral or a manufactured artificial mineral or optical compound. The design is such that when illuminated and viewed from the front the light falling upon it is largely refracted, internally reflected and returned to the front so that the jewel stone appears bright. The refraction and reflection process may also change the color of the light emitted after passing through the jewel stone and re-emerging. Jewelry including one or more jewel stones is generally designed so that it does not pass light from the front to the rear. Thus when illuminated from the front and viewed from the rear, the jewel stones appear dull.

The process of design and manufacture of jewelry often involves cutting the mineral into carefully designed angles and facets that are intended to achieve the desired optical effects of causing the front surface to sparkle or scintillate as the refraction and reflection occurs. Such optical effects occur when the jewel stones catch external light at certain incident angles and reflect or diffuse the light.

FIGS. 28(*a*)–(*c*) show side, top and bottom views of a brilliant cut jewel stone 210. As shown in FIG. 28(*a*), the top part 212 is called a "crown", the bottom part 216 is called a "pavilion", and the connecting part 214 between the crown 212 and the pavilion 216 is called a "girdle". As shown in FIG. 28(*b*), the crown 212 comprises the face of the brilliant cut called a "table" 222 and inclined surfaces called "top facets" including "stars" 220 surrounding the table 222, "bezels" 218 surrounding the stars 220 and "top girdle facets" 224 located between the bezels 218 and girdle 214. As shown in FIG. 28(*c*), the pavilion 216 comprises the base called a "culet" 228 and inclined surfaces called "pavilion facets" including "pavilions" 226 surrounding the culet 228 and "bottom girdle facets" 230 located between the pavilions 226 and the girdle 214.

Such brilliant cut jewel stones may be made from a wide number of materials, for example , diamonds or cubic zirconium which is a material approaching the hardness of diamond and often used as an artificial replacement.

Scintillation is the word generally associated with jewelry that sparkles. The scintillation effect is most pronounced when correctly designed jewels are illuminated with a point source such as a candle and the jewel is moved through some angular rotation. Very small angular movements can provide substantial scintillation by virtue of the multiple internal reflections, refractions and dispersions which are given words such as fire and brilliance.

Each of FIGS. 27(*a*)–(*f*) shows a cross section of a brilliant cut jewel stone 200 indicating the way in which light 202 falling on a surface 204 of each jewel stone 200 is refracted by the surface 204, internally reflected by the pavilion facets and then refracted for a second time by the surface 204 as it leaves the front of the jewel stone 200. When the light falling on the front face of the jewel stone is returned, the jewel stone appears to sparkle.

When proportions of the jewel stone are perfect as shown in FIG. 27(*a*), all light gets reflected back, either via the table or the top facets, so that brilliance is achieved. However, as shown in FIGS. 27(*b*) and 27(*c*), if the pavilion is too deep or too shallow, part of the rays of incoming light "escapes" through pavilion facets. As shown in FIGS. 27(*d*)–(*e*), if the crown is too low, less refraction occurs by the crown facets. Thus, brilliance is most dependent on the angles of pavilion facets, and fire depends on angles of crown facets.

The sparkling is also due in part to the dispersion of the generally white light and its breakdown into a number of constituent colors, each of which emerges with a slightly different beam angle. FIG. 29 shows a curve of variation of refraction coefficient for various different colors of light which gives an indication and measurement of this dispersion effect.

Although jewel stones are generally designed to have optical effect, when external light is not strong enough, little optical effect including scintillation effect occurs and the colors of the jewel stones are not readily visible. Further, when there is no relative movement between jewelry, the viewer and external light, jewel stones do not produce any optical effect even if enough ambient light is present.

Artificial illumination of a jewel in an article of jewelry has previously been described in GB 1 352 835, where a translucent jewel can be illuminated intermittently by battery-powered light-emitting diodes provided on the non-viewing side of the article. The LED's can be pulsed by signals from an control circuit which are generated by sensing the wearer's movement, or external sound or light.

Another artificially illuminated article of jewelry is described in U.S. Pat. No. 4,973,835 where a light emitter is provided near a transparent body (jewel). The light emitter is frequency pulse generators and a light detector. When the signal processor receives a low-light signal, the light detector signal being sampled at the frequency of one of the pulse generators, the processor controls the light-emission timing to cause the light emitter to emit light at the frequency of the other frequency generator. Otherwise, the light emitter is not driven and the jewel is not illuminated by the light emitter.

In the prior art, the jewel illumination is at best rather crude. In both GB 1 352 835 and U.S. Pat. No. 4,973,835, the pulsing of the LEDs is entirely dependent on external conditions such that the illumination lacks consistency. During periods of time where the sensed matter does not change, the illumination is inactive. For example, in GB 1 352 835 when a motion sensing device is employed and the user is stationary, light pulses are not generated. Also in the device of U.S. Pat. No. 4,973,835 light pulses are not generated in bright light conditions. Furthermore, in low-light conditions, the U.S. Pat. No. 4,973,835 device can only produce a consistent repeating pattern of light pulses at a regular frequency from which it is apparent that there is artificial lighting of the jewel. As digital pulses are used in both of the above described prior art arrangements to drive the LEDs, the duration and the intensities of the light pulses emitted from each LED are constant. The resultant light output does not mimic natural illumination of the jewel.

All of the above features of the prior art devices make the artificial illumination of the jewel used therein readily distinguishable from natural light illumination of a jewel. More particularly, the prior art devices produce illumination light pulses which are either too regular or too irregular to be of effective use in simulating the so called natural optical effects such as sparkle or scintillation of the jewel.

SUMMARY OF THE IVENTION

An object of the present invention is to provide an article of jewelry where the jewel is artificially illuminated in such a way as to simulate realistic optimum natural illumination. The desired illumination is that which generates simulated natural optical effects in the jewel such as sparkle, scintillation and glow.

According to one aspect of the present invention there is provided an article of jewelry arranged to simulate natural optical effects, such as sparkle and scintillation, the article comprising: a jewel; a light source incorporated in the article of jewelry for emitting light so as to illuminate the jewel; and means for controlling the light source to emit light pulses which are variable in intensity, thereby simulating said natural optical effects of the jewel.

By incorporating the light source in the article of jewelry and controlling the intensity of each emitted light pulse, the jewel interacts with light emitted from the light source and scintillates, sparkles and/or glows by itself. Thus, an article of jewelry embodying the present invention can maintain or enhance its attraction in the dark and in the presence of ambient light. The stimulation of optical effects is performed to simulate natural optical effects of the jewel.

The term 'jewel' is to be construed broadly throughout this description to mean any article or material having optical reflective and/or refractive properties. Examples of such jewels are one or more precious stones such as diamonds or rubies, semiprecious stones, imitations of these stones made form artificial materials or even small reflective metallic objects. These jewels may be combined aesthetically as desired.

The generation of light pulses in this way simulates the natural internal optical reflections of an externally illuminated jewel. More specifically, by use of illumination pulses which are not of a constant intensity, the movement between the jewel and an external light source is simulated.

These effects are preferably obtained through the use of extremely small internal light sources, such as light emitting diodes, which are controlled to alter the position, number, intensity and color of the illuminated gemstones in a pseudo-random pattern although other deliberately repetitive patterns are possible. Because of the requirement for a natural appearance, the illumination patterns are more subtle and complex than have been used previously.

Preferably the control means is arranged to cause the light means to emit light pulses in which the light output intensity is controllably varied along the duration of each pulse. In this way, the intensity profile of each light output pulse can be controlled to accurately mimic the profile of reflected or refracted light pulses seen by natural illumination of the jewel or gemstone. For example, by varying the amplitude (intensity) of a given light pulse over time, the jewel can be made to appear to glow. In a presently preferred embodiment, the light intensity is made to decrease along the duration of each output light pulse. This simulates scintillation profiles seen in natural illumination of gemstones.

In addition or alternatively, the control means may be arranged to cause the light means to emit light pulses in which the peak light output intensity is controllably varied along a sequence of light output pulses. The light output produced in this way simulates gently flickering reflection. This effect can be enhanced by randomizing the selection of the peak light output intensity of each light output pulse.

Preferably the control means is arranged to cause the light source to emit a series of light pulses in which each light pulse has a controllably variable duration. This advantageously enhances the overall simulation of natural illumination of the jewel. Preferably the selected duration for each light pulse is randomized to further improve the realism of the artificial illumination.

The control means preferably directly energises the light sources and controls the precise light output from each light source, such as the pattern, amplitude and duration of light pulse emission. For example, an application specific integrated circuit (ASIC), such as a complementary metal-oxide semiconductor (CMOS) ASIC, may be used as a suitable control means. Optimal patterns may be determined experimentally and different effects may be obtained by different patterns.

In a presently preferred embodiment, relative movement is also simulated by providing a plurality of spaced apart light sources, each light source being arranged to illuminate the jewel from a different location, and the control means is arranged to apply electrical pulses to selected ones of said light sources. The selection of the particular light source can be randomized such that the light reaching the viewer appears to come from different positions within the jewel which represents a more realistic optical movement effect. The light sources can be positioned symmetrically about the jewel and the control means can be arranged to cause emission of light pulses from the light sources in a sequential manner. This arrangement can produce a rotational optical effect which has a particular advantage of increased attractiveness in jewels that are designed to have a radial reflection or refraction elements.

A jewel may be coupled to more than one light source so as to stimulate different optical effects from different parts of the jewel as stated above. If a jewel is not located close to a light source and would not easily receive light emitted from the light source, then optical guiding means such as an optical fiber may be provided between the jewel and the light source.

In one embodiment of the present invention, the light sources are arranged to emit different colored light pulses. This advantageously provides simulation of the natural refractive optical effects that are seen in an externally illuminated jewel. Advantageously, realistic visual effects can be produced by the article of jewelry by arranging the control means to vary the color by random selection of the color of the next pulse to be emitted.

In another embodiment of the present invention, the light sources are combined to form a suitable light source for emitting multiple modes of light. Especially, an LED array having a plurality of LEDs is suitably used.

It is desirable to use a multi-color light source or a white light source, which can be refracted and separated into its constituent wavelength components. LEDs currently available are in individual colors, which are close to monochromatic. Multi-color LEDs or white LEDs are not currently available. Accordingly, it is preferable to utilise more than one color LED at a given location in order to produce simulation of the same optical effects as a multi-color or white light source. For example, when red, green and blue LEDs are energized, some composite light output approaches white light.

Preferably, the control means is arranged to generate multiple sequences of pulses, each sequence being independent from the other, for driving the light sources simultaneously. In this way, when different color light sources are activated simultaneously, the natural optical effect of bicolor or tricolor dispersion can be simulated.

It is further preferable that the control means is arranged to vary the light emission in response to changes in ambient conditions and/or movement of the article of jewelry. To this end, the article of jewelry may comprise detecting means for detecting such changes in ambient conditions and/or movement of the article of jewelry. The detecting means may comprise one or more environmental sensors which detect one or more of parameters including ambient temperature, ambient noise, ambient light, skin temperature and pulse rate of the wearer of the article of jewelry. Any kind of sensor may be used for this purpose so long as it is small enough to be incorporated in a particular design of the article of jewelry. For example, a photodiode may be used to detect ambient light levels.

The control means preferably performs an algorithm to change the patterns, amplitude and/or duration of the light emission in response to the detection of the detecting means. For example, the controller may increase the amplitude and frequency of impulses of light emission as darkness falls and the activity of the wearer of the article of jewelry increases.

In order further to stimulate optical effects, the article of jewelry may also have a reflector or a mechanical system incorporated in the article of jewelry. A mirror may be used as a suitable reflector to reflect light emitted from the light source or light reflected by the jewel or other reflectors. The mechanical system may comprise vibration means or a movable member which vibrates light emitted from the light source. The movable member may be a rotatable reflector or rotatable disc or shutter pierced to create differing patterns of light.

It is preferable to provide the light source without affecting the performance of the jewel when viewed normally with front lighting. To this end, it is preferable that the direct visual path from the light source to the viewer is minimized. That is, all light reaching the viewer is preferably internally reflected in the jewel at least once and/or refracted at least once before reaching the eye of the viewer.

In order to produce such reflection and refraction, it is preferable to position the light source in a cavity provided in the jewel, so as to allow the light source to be centered somewhere within the jewel. Through the cavity, the light source may be connected to the control means.

Instead of positioning the light source itself in the cavity, an end of an optical guiding means may be brought into the cavity, and the light source may be located outside the jewel.

The cavity is preferably tapered from a non-viewing side of the jewel toward the interior of the jewel so as to reflect, by walls of the cavity, the light falling on the front of the jewel back towards the viewer. A conical cavity or a pyramidal cavity may be suitable.

It is preferable to provide, on the non-viewing side of the jewel, a base plate having a reflecting surface to reflect the light falling on the front of the jewel back towards the viewer.

It is also preferable to provide an opaque reflective coating or an opaque mirror within the cavity. The opaque reflective coating or mirror has two purposes: firstly to block the direct path of light from the light source to the eye of the viewer; and secondly to reflect the light from the light source back to a base reflecting surface provided at the non-viewing side of the jewel, which then in turn re-reflects it back towards the front (viewing side) of the jewel.

A further reflective mirror may be incorporated at the entrance to the cavity, such that all light from the reverse emission of the light source can be reflected back up into the jewel to add to the light emitted directly into the jewel.

An alternative to positioning the light source within a cavity is to utilize a so called 'special cut' feature. The special cut feature is a prismatic cavity provided in the jewel stone preferably at a non-viewing side of the stone. The light source or sources are provided laterally spaced apart from the prismatic cavity and have their light beam paths directed towards the prismatic cavity. The light sources are positioned such that their light beam paths are approximately transverse to the direction required to direct light out of the jewel to the viewer. However, when light falls one the prismatic cavity, it is reflected at substantially 90° such that it then is directed to the viewer's eye. Similarly to the pyramidal cavity described above, the special cut feature also advantageously does not have a direct illumination path from the light source to the viewer's eye. Furthermore, the special cut feature advantageously removes the need for a metallized portion in the cavity, provides greater freedom to the jewelry designer in the positioning of the light source(s) and allows more that one light source to be used concurrently in the illumination of the jewel.

A natural effect that occurs when reflection and refraction take place from a front illuminated cut jewel is called by various names but 'sparkle' is one suitable description. During the sparkle effect some parts of the jewel are seen as bright and others remain less bright. Moving the jewel causes a change in the points of light that are generated.

In some of the above described embodiments of the present invention, problems can occur sometimes in the effective simulation of the sparkle effect because of the general scattered nature of the light emitted by an LED light source. The internal reflections that take place when a cut stone jewel is illuminated by such an LED light source are seen by the viewer as a uniformity of color and intensity throughout the jewel. Such an appearance is quite unlike the sparkle effect described above.

It has been found that the sparkle effect can be obtained from LEDs in the above described articles of jewelry by collimating the output of each LED light source. In an embodiment of the present invention, collimation is achieved simply by providing a miniature collimating lens adjacent the output of each LED. A collimated light source has the effect of generating high and low points in the viewer's image and this closely resembles the natural lighting effects associated with 'sparkle'. Movement of the jewel is emulated by the variable intensity light pulses of the present invention.

Preferably two or more collimated LED's located at different positions on the non-viewing side of the jewel are provided in the article of jewelry. The collimated light output of each LED produces a unique spatial illumination pattern within the jewel. When switching between the spatial illumination patterns the 'sparkle' effect seems to move within the jewel.

The above described effects can all be combined together or combined selectively together to produce an extremely realistic simulation of the natural optical effects of an externally illuminated jewel.

The article of jewelry is assembled into an artistic aesthetic design that is found to be attractive in its own right. The article of jewelry may be a final product, such as a piece of jewelry, pendant, bracelet, brooch, watch etc., or may be a module which is ready to be assembled with a frame of such a final product.

Thus, according to the article of jewelry of the present invention, an optical device is combined with a jewel to produce a hybrid construction of the jewel in which the jewel is stimulated by controllably variable intensity outputs of the optical device to artificially produce or enhance optical effects of the jewel.

In practice, the prior art articles of jewelry have incorporated a small cell/battery to energise the electronic circuitry and to power their light source. The power demands of the article of jewelry and the capacity of the cell determine the how long the life of the cell will be before it requires replacement. As a practical matter, it is a major requirement of the power supply that it can provide power for at least one full wearing, which can be for example from 5 to 10 hours.

Preferably, the article of jewelry embodying the present invention comprises a rechargeable power supply. Such a rechargeable power supply can meet the above life-span requirement without the need for and unduly large cell capacity, and also can advantageously avoid the problem of frequent battery replacement. The use of a rechargeable battery enables the article of jewelry to be recharged after each wearing when the article is not being worm, until its next wearing.

Preferably, the article of jewelry further comprises means for charging the power supply. The charging means may advantageously be arranged to receive power by indirect electrical connection to an external power supply. Accordingly, the need for electrical contacts, which can detract from the appearance of the article, between the article of jewelry and the external power source can be avoided. In a presently preferred embodiment of the invention, the indirect electrical connection is achieved by the charging means comprising a non-contact inductive loop circuit.

An external charging circuit, connected to the external power supply, can be built into and concealed within a jewelry stand, such as a ring tree, or a jewelry case/box. The user simply uses the stand or case in the normal way and the article is recharged without undue fuss when not in use. This provides an attractive way of recharging the power supply in the article of jewelry which requires no special instructions.

According to another aspect of the present invention there is provided a combination of an article of jewelry as described hereinabove, and a charging circuit external to said article, said external charging circuit being connectable to a permanent mains power supply.

According to another broad aspect of the present invention there is provided an article of jewelry comprising: means for illuminating a jewel of the article; and a rechargeable power supply for powering the illuminating means. As mentioned previously, this has the advantage of avoiding the costly and laborious task of regular battery replacement. In addition, the battery capacity can be selected to last just a single wearing of the article and so the size of the battery can advantageously be minimized.

The rechargeable power supply is preferably arranged to receive power by indirect electrical connection to an external power source. Therefore, the need for electrical contacts between the article of jewelry and the external power source can be avoided. This in turn prevents the appearance of the article from being unattractively altered to accommodate the contacts.

According to another broad aspect of the present invention there is provided a method of illuminating a jewel for simulating natural optical effects of the jewel, such as sparkle and scintillation, the method comprising: providing a light source adjacent the jewel for emitting light so as to illuminate the jewel; and controlling the light source to cause it to emit light pulses which are variable in their intensity, thereby simulating said natural optical effects of the jewel.

According to another broad aspect of the present invention there is provided a system for illuminating a jewel for simulating natural optical effects of the jewel, such as sparkle and scintillation, the system comprising: a light source positionable adjacent the jewel for emitting light so as to illuminate the jewel; and means for controlling the light source to cause it to emit light pulses which are variable in their intensity, thereby simulating said natural optical effects of the jewel.

The present invention also extends to an object incorporating a system as above described, wherein a portion of the object is illuminated by the system. For example, a portion of a mobile phone, or a clothing accessory such as a handbag, or even an portion of a dress could be illuminated by the system to enhance its attractiveness to the user.

In the presently preferred embodiments of the invention, the light source is a light emitting diode. However, this type of light source may be replaced by any suitable light source as long as it is readily controllable, is not unsuitably large for incorporation into an article of jewelry and does not consume unsuitably large amounts of energy. One alternative source of light is to use electronic luminous plastics materials, which emit a particular wavelength of light when an electrical current is passed through them. Different types of these plastics materials can be used to generate the required different colors of illumination for the jewel. Another alternative is to use a chemical light source which emits light by a chemically reactive process.

The present invention also extends to an article of clothing incorporating a one or more articles of jewelry as described above. For example, a clothes designer working at top couturier level can therefore design and make a dress or a jacket embroidered with scintillating jewels which would always exhibit their optimum optical characteristics due to the artificial illumination. The illumination of each jewel in the dress would be controlled from a central electronic system and the wiring between the jewels and the system would simply be incorporated into the lining of the dress. Also, there would be no need to provide real jewels as artificial jewels optimally illuminated would be quite effective in producing the desired effect at a fraction of the cost.

BRIEF DESCRIPTION OF THE DRAWINGS

Preferred embodiments of the present invention will now be described by way of example with reference to the accompanying drawings. In the drawings:

FIG. 18(*b*) is a cross-sectional view of a jewel stone and a base incorporating a light source according to a fifth embodiment of the present invention;

FIG. 18(*c*) is a partial enlarged view of the jewel stone and base shown in FIG. 18(*b*);

FIG. 18(*d*) is a schematic cross-sectional view of the jewel stone and base shown in FIG. 18(*b*) showing refraction and reflection of light;

FIG. 19(*b*) is a cross-sectional view of a jewel stone and a base incorporating a light source according to a sixth embodiment of the present invention;

FIG. 19(*c*) is a cross-sectional view of the jewel stone and base shown in FIG. 19(*b*) schematically showing refraction and reflection of light;

FIG. 22(*b*) is a schematic cross-sectional view of a conventional collimated light beam package showing the degree of divergence in the light beam;

FIG. 28(*b*) is a top view of the jewel stone shown in FIG. 28(*a*);

FIG. 28(*c*) is a bottom view of the jewel stone shown in FIG. 28(*a*);

FIG. 30(*b*) is a schematic plan view of the jewel shown in FIG. 30(*a*); and FIG. 30(*c*) is a schematic cross-sectional view of another jewel showing a special cut feature as an alternative to that shown in FIGS. 18(*b*) and 19(*b*).

DETAILED DESCRIPTION OF THE PREFERRED EMBODIMENTS

Figure 1:
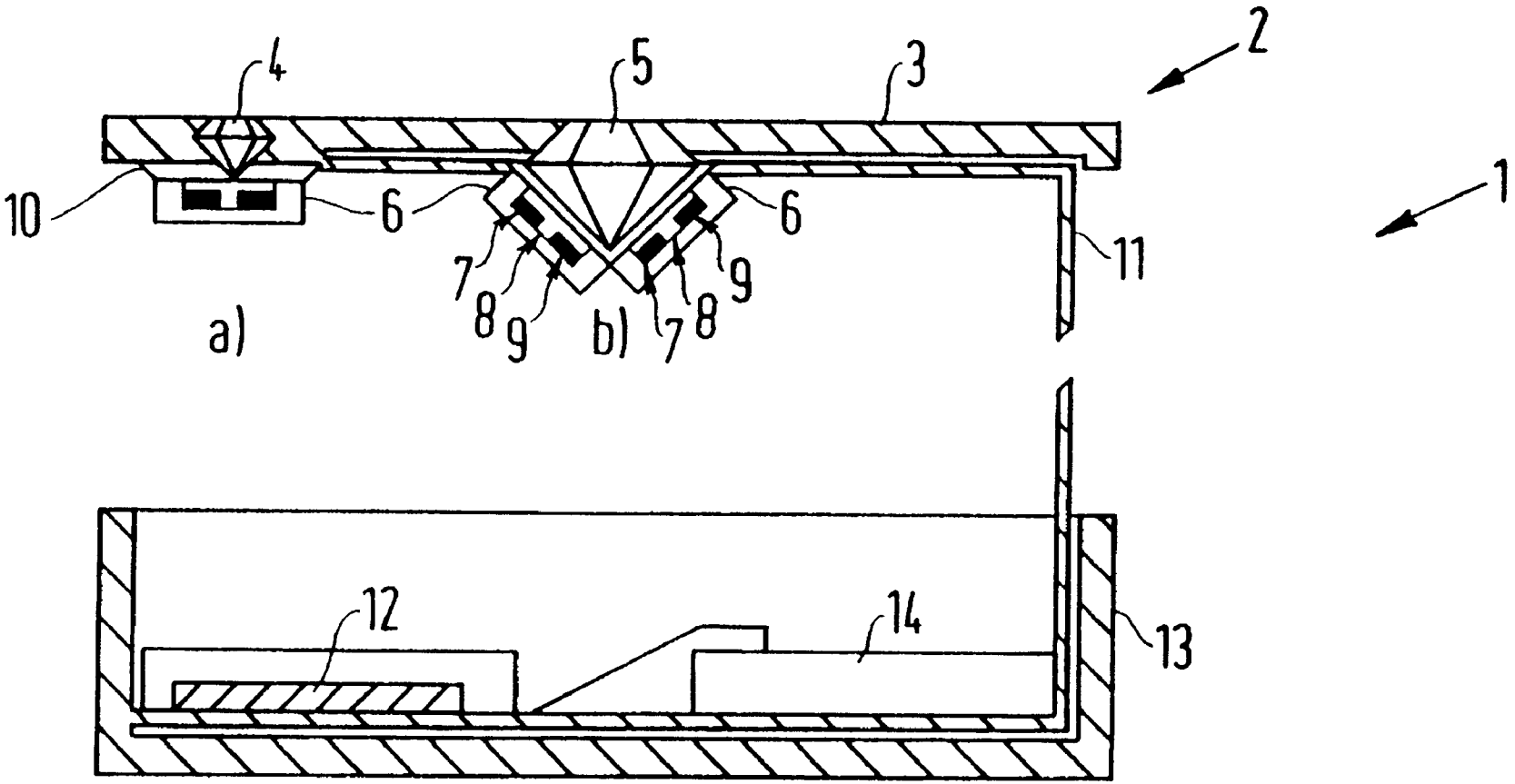
FIG. 1 is a schematic cross-sectional view of a pendent having jewels mounted on the pendent face and an illumination system of the first embodiment of the present invention.
Figure 2B:
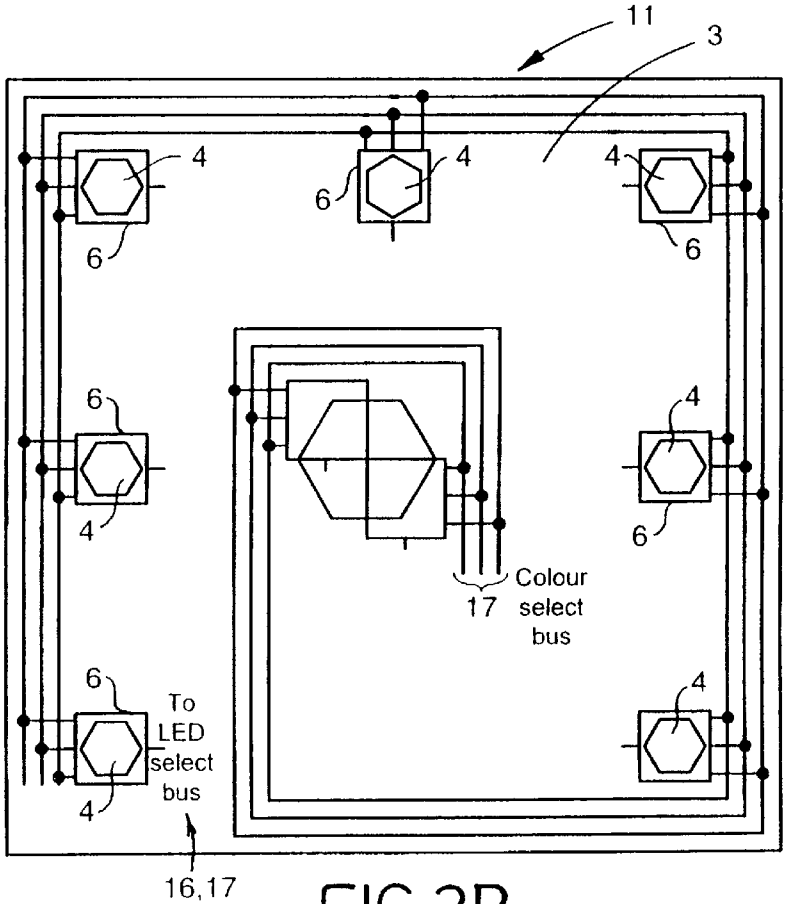
FIGS. 2A and 2B show two schematic plan views of the interior layout of the pendent of FIG. 1, the views showing the major electrical components and their interconnections.
Figure 2A:
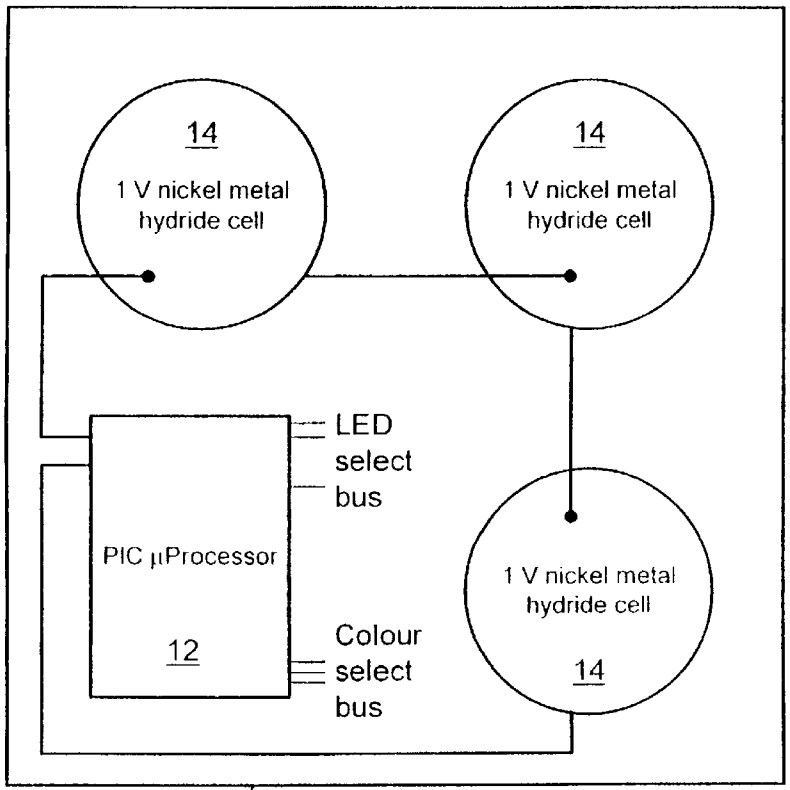

Referring to FIGS. 1, 2A and 2B there is shown a first presently preferred embodiment of the invention. FIG. I shows an illumination system 1 used in an item of jewelry namely, in a box pendant 2 whose face or lid 3 carries several large and small inset gemstones 4, 5. Other geometrical configurations of the system are evidently possible as is the use of the system I in other types of jewelry. Beneath each gemstone 4, 5 are one or more small packages 6, each package 6 containing a red LED 7, a green LED 8, and a blue LED 9. A single package 6 is cemented directly beneath each small gemstone 4 as seen at mounting a) using an index-matching cement 10 and two packages 6 are fixed to the undersides of the large gemstone 5 as seen at mounting b). Each package 6 is a surface mount device (SMD) package which takes up minimal space and depth. However, bare LED dies can also be used though these are invariably larger in size.

The LEDs 7, 8, 9 are linked together by a wiring harness 11, which is formed from a flexible printed circuit board. The wiring harness 11 is also connected to a PIC microprocessor 12, which is mounted in the pendant base 13 together with a rechargeable battery 14. Limiting resistors 15 (see FIG. 6) are provided to control the amount of drive current supplied to each type of LED 7, 8, 9. An on/off switch (not shown) and an arrangement for recharging (not shown) are also provided. Thus, the main components of the illumination system 1 are the PIC microprocessor 12, the array of LEDs 7, 8, 9, the limiting resistors 15, and the rechargeable battery 14.

The LEDs 7, 8, 9 are current-driven light sources, which require forward currents of 1 to 10 mA at voltages of order 2 V. The PIC microprocessor 12 requires a voltage of at least 3 V, and can source currents of the correct value directly when fitted with suitable series limiting resistors 15. The energy needed to drive the PIC microprocessor 12 and the LEDs 7, 8, 9 is stored in the rechargeable battery 14. At present, the most suitable compromise between storage capacity, voltage and discharge current available in a rechargeable format is offered by a 3-cell nickel metal hydride battery 14 and this is used in the present embodiment.

SMD LEDs are available with monochromatic single light output (e.g. red, orange, yellow, green and blue) with a typical footprint of 2.0 mm×1.25 mm×1.1 mm.

Figure 3B:
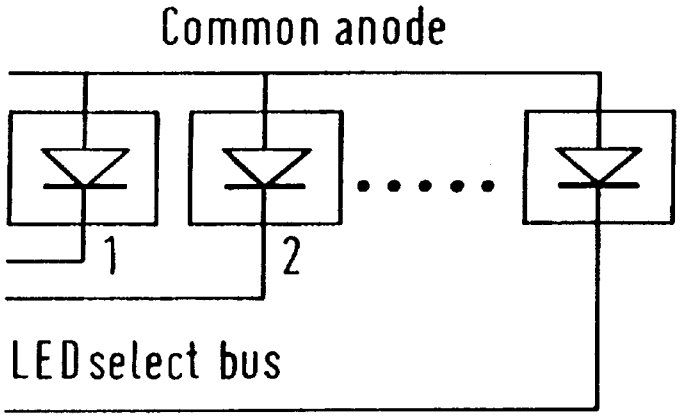
FIGS. 3A and 3B are schematic wiring diagrams respectively showing an array of single-color LEDs connected together in a common-anode configuration and a common-cathode configuration.
Figure 4C:
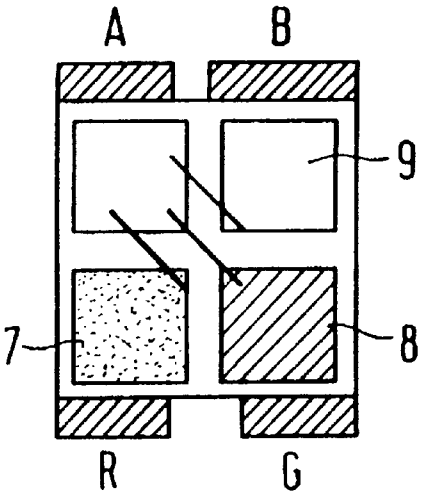
FIG. 4C is a schematic plan view of the internal wiring of the SMD RGB LED package of FIG. 4B.
Figure 3A:
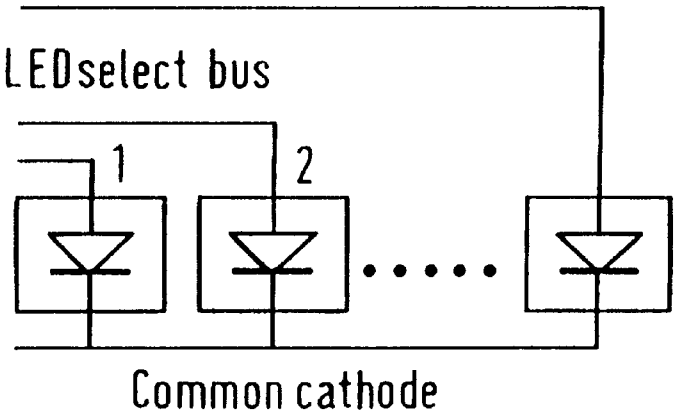
Figure 4B:
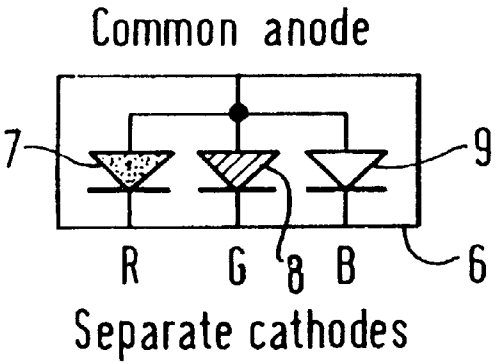
FIGS. 4A and 4B are schematic wiring diagrams respectively showing an RGB LED package having internal connections in a common-cathode configuration and a common-anode configuration.
Figure 4A:
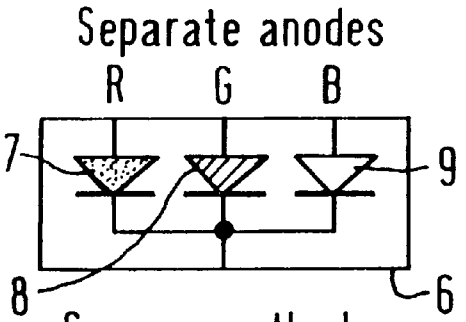

These LEDs may simply be wired together using external common-anode connections as shown in FIG. 3A or using external common cathode connections as shown in FIG. 3B. However in the present embodiment, combined red, green and blue (RGB) LEDs 7, 8, 9 in SMD packages 6 are used. These combined RGB LEDs 7, 8, 9 are wired together internally by common-anode or common cathode connections as shown in FIGS. 4A and 4B respectively. FIG. 4C shows the internal connections for the common anode configuration of the RGB SMD LED package 6. A typical RGB SMD LED package footprint is 3.5 mm×3.0 mm×2.1 mm.

The electro-luminescence efficiencies of the red, green and blue LEDs 7, 8, 9 vary considerably; red LEDs 7 are the most efficient, and blue LEDs 9 the least efficient. This is reflected in their respective required drive currents and forward voltages (typically 2 mA, 10 mA and 50 mA, and 1.8 V, 2.0 V and 4.1 V for red, green and blue LEDs, respectively). However, SMD LED technology is developing rapidly. Older, less efficient, LEDs have been replaced by "superbright" LEDs, and now more recently by "hyperbright" LEDs. Increasing the efficiency of the SMD LEDs means that less current will be required to produce an acceptable light output and, accordingly, the power consumption will decrease, thereby extending battery life.

Figure 5:
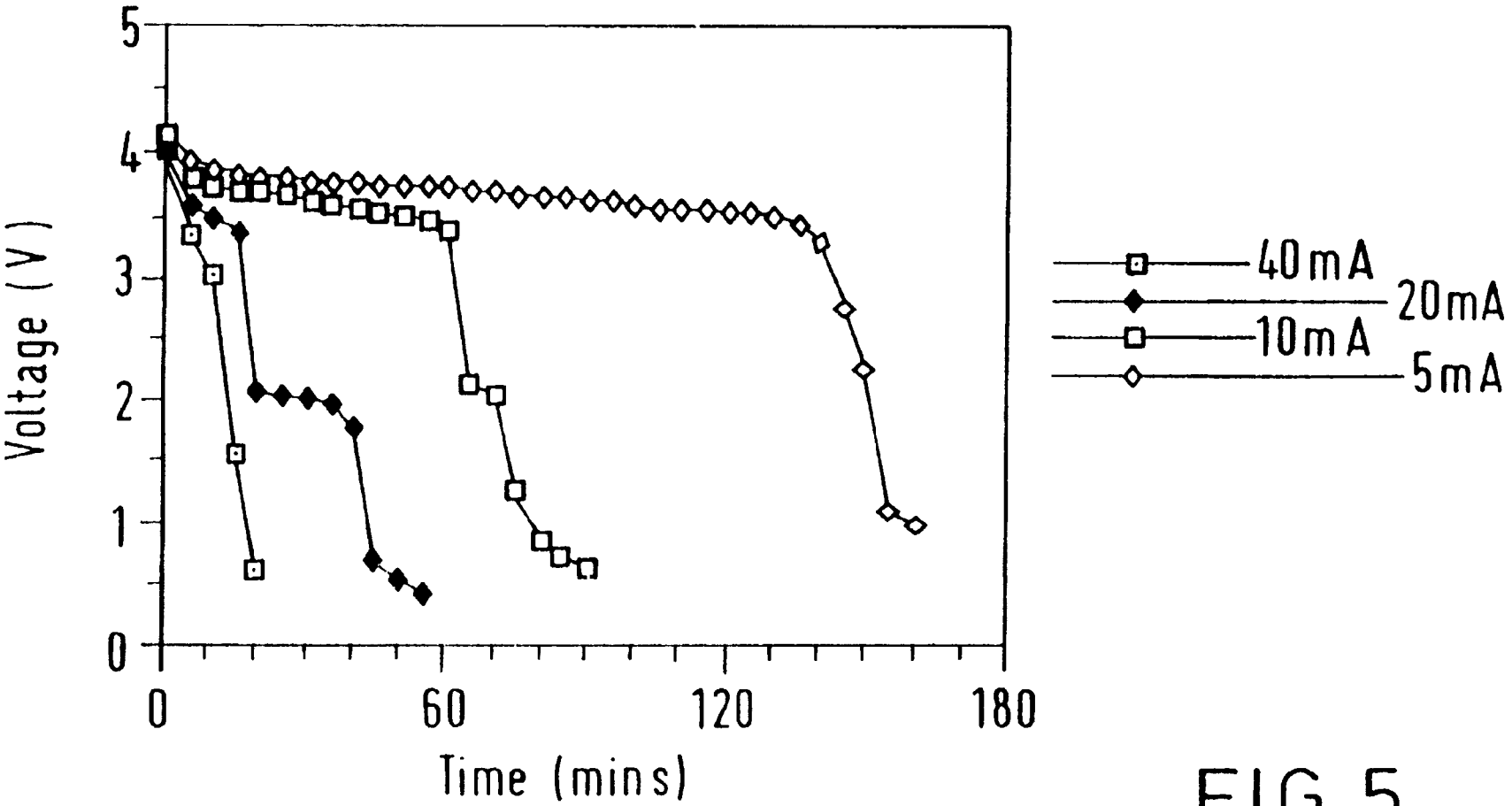
FIG. 5 is a graph of voltage output against time illustrating the discharge characteristics for a VARTA 11 mAh rechargeable nickel metal hydride battery shown in FIGS. 1 and 2.

The LEDs 7, 8, 9 consume the vast majority of the energy supplied to the circuit. Assuming a continuous current of 10 mA (i.e., one LED consuming 10 mA, held on continuously) approximately 1 hour of operation can be provided by a VARTA (Trademark) 11 mAh nickel metal hydride battery 14. The duration of operation can be increased by reducing the discharge current, but 10 mA represents the largest discharge current for efficient operation. Typical discharge characteristics of this type of cell over a range of currents from 5 mA to 40 mA are shown in FIG. 5. Recharging is typically performed at 0.1 ×capacity, i.e. at a recharging current of 1 mA; full recharging may therefore be performed in 10 hours, i.e. overnight. A 3-cell stack of this type has dimensions 10.5 mm×12.0 mm diameter; when split into 3 separate cells, as in the present embodiment, each cell has dimension 3.5 mm×12.0 mm diameter. The recharging is carried out in this embodiment via miniature electrical contacts (not shown) are provided in a wall of the box pendant 2. These miniature contacts enable a charging unit (not shown), which can be in the shape of a figurine or a simple pedestal for example, to supply electrical current to the pendant box 2 for recharging of the batteries 14.

The capabilities of the microprocessor 12 are necessarily limited, in terms of electrically-programmable read-only memory (ROM), random-access memory (RAM) and addressing power. The PIC microprocessor 12 used in the present embodiment is the 16C54 from Microchip Technology Inc., which is an 18-pin device in a package measuring 7.0 mm×12.0 mm×2.5 mm (excluding pins). The PIC microprocessor 12 contains 512 bytes of one-time programmable ROM, and 32 bytes of RAM. It has two programmable I/O ports, one 4-it, the other 8-it. The PIC microprocessor 12 drives the LEDs 7, 8, 9 directly without the need for other external components; the only additional external components used are a single resistor and a capacitor (not shown), which are needed to set up the processor clock, and the limiting resistors 15.

Figure 6:
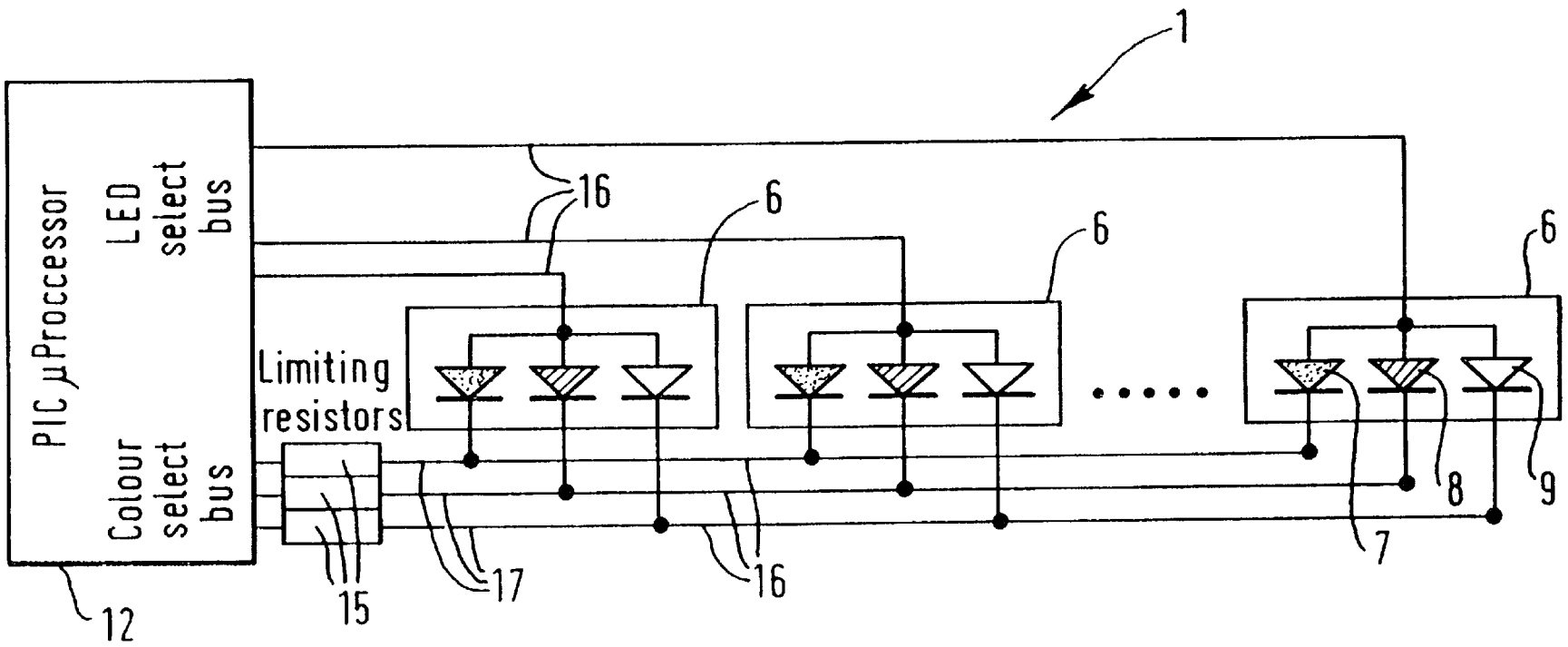
FIG. 6 is a schematic wiring diagram of the illumination system of FIGS. 1, 2A and 2B showing the partially independent addressing of the PIC microprocessor.

Independent control of N different single-color LEDs clearly requires the availability of N separate address lines 16 from the PIC microprocessor 12. Similarly, independent control of N different RGB LEDs 7, 8, 9 requires 3×N address lines 16. The latter figure may exceed the PIC microprocessor's limited capabilities when N is not relatively small. A compromise is to use N address lines 16 to select one of N different RGB LED packages 6, and three address lines 16 to select the color of the light output from each package 6, as shown in FIG. 6. Each of the address lines 16 is provided with one of the limiting resistors 15 to limit the drive current for a corresponding LED drive circuit. The number of address lines 16 required is then 3+N, which is a considerable reduction. Thus, for the 16C54 PIC microprocessor 12, up to 8 different RGB LED packages 6 may be selected using the 8-it port, and the color output of each LED package 6 can be controlled by three I/O lines 17 of the 4-it port, which leaves one I/O line 17 free. This last I/O line 17 is controlled by some simple software running on the PIC microprocessor 12 which allows multiple use of this last I/O line 17 as an ON/OFF control for the system 1, a programming line (not shown) and also for controlling the $9^{th}$ LED package 6.

It is to be appreciated that there are other PIC microprocessors with extended addressing capabilities, namely larger I/O ports which could be used in place of the present PIC microprocessor 12. These larger PIC microprocessors have the capability of controlling larger numbers of LED packages 6 using the same addressing techniques described above.

The illumination patterns generated by the PIC microprocessor 12 mimic the reflected pattern of light arising from the motion of the wearer relative to one of a number of external natural light sources. Several natural optical effects can be simulated by the present embodiment of the invention, namely: simulation of polychromatic reflection; simulation of natural sparkle or flicker; simulation of natural color variations arising from dispersion and simulation of motion.

Figure 7:
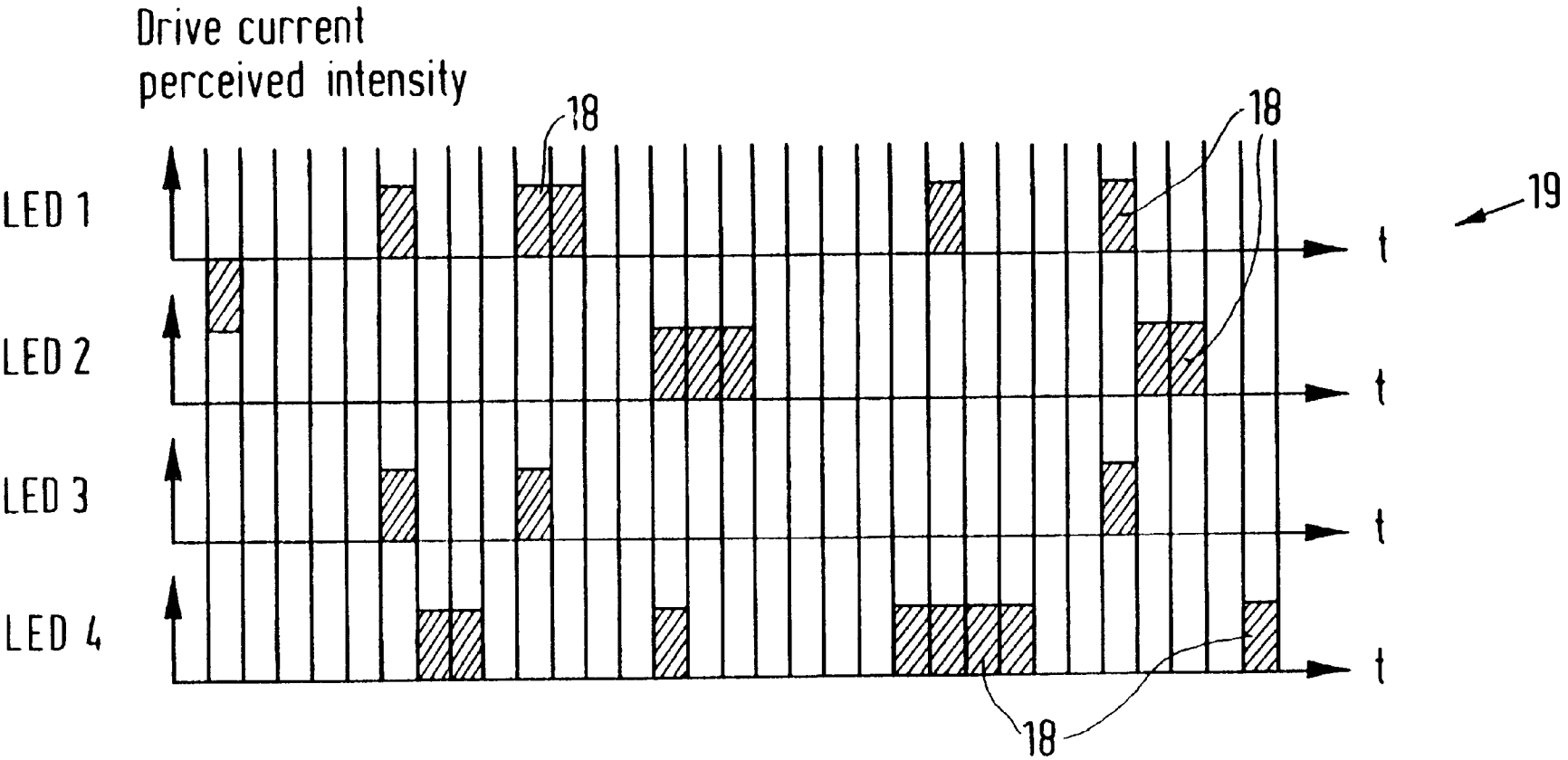
FIG. 7 is a graphical representation of drive current output against time for several LEDs illustrating a method of driving LEDs in a conventional manner to illuminate a jewel which produces a non-realistic simulation of natural optical effects.

Since the LEDs 7, 8, 9 are under the control of the microprocessor 12, they are driven digitally, by switching a drive current to each LED 7, 8, 9 on and off according to a predetermined sequence. FIG. 7 shows an elementary timing sequence 19 which could be generated using conventional driving signals. Here, a number of monochromatic LEDs are driven randomly at intervals with binary current pulses 18, i.e. pulses of equal height and duration. As a result, the optical light output pulses are also of equal color, intensity and duration. It is therefore simple for an observer to detect that the displayed pattern is not natural, and although the random sequence 19 may be sufficiently long that no repetition is noticed, it appears mechanistic and unattractive.

Figure 8B:
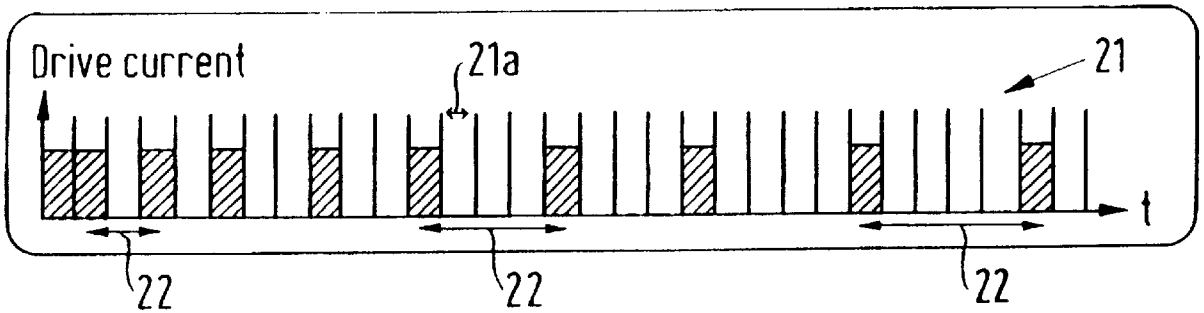
FIG. 8B is a graphical representation of drive current output against time illustrating a method of driving the LED to generate the decaying light pulse of FIG. 8A according to the first embodiment to simulate natural optical effects.
Figure 8A:
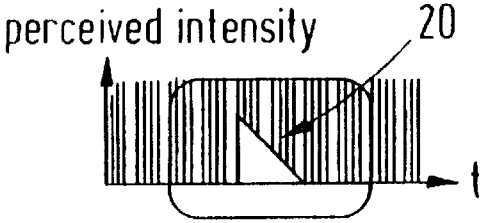
FIG. 8A is a graphical representation of perceived intensity output against time for a decaying luminescence light pulse from an LED according to the first embodiment of the present invention.

A considerably more realistic effect is obtained in the present embodiment of the invention by replacing the digital illumination pattern 19 with an analog one whereby the LEDs 7, 8, 9 are driven so that the output light pulses are no longer of constant intensity and duration. FIG. 8A shows one possible pattern 20 which is used in the present embodiment. In this pattern 20, an initial rapid rise to a peak intensity is followed by a slower decay to zero. An intensity variation of this type is still obtained by the PIC microprocessor 12 modulating the LED 7, 8, 9 digitally with a binary pulse sequence 21, but by using a higher modulation frequency (1/period 21*a*), and varying the duty cycle 22 from an initially high value to a low value as shown in FIG. 8B. If the modulation frequency is sufficiently above the high-frequency cut-off of the eye response (around 50 Hz), the perceived result is a low-pass filtered envelope similar to the desired pattern or analog light pulse shape 20. The higher the modulation frequency the greater the resolution of amplitude control of the analog driving signal. Suitable light pulse shapes 20 are generated using a modulation rate of around 16×50=800 Hz. The light pulses output by the LED 7, 8, 9 driven by such analog pulses 20 are attractive, and have the appearance of gradually decaying luminescence.

Figure 9:
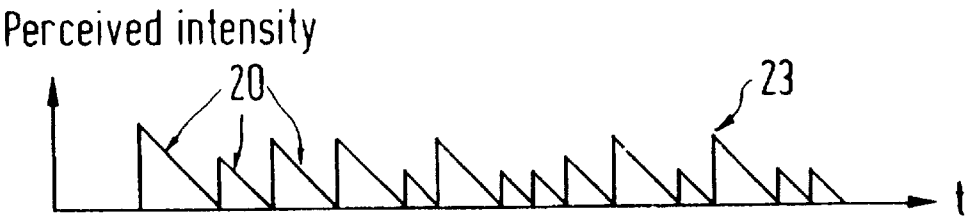
FIG. 9 is a graphical representation of perceived intensity output against time for an analog pulse sequence for an LED illustrating a method of driving an LED according to the first embodiment of the present invention to simulate natural optical effects.

Further effects are possible by the PIC microprocessor 12 using this analog approach. For example, the PIC microprocessor 12 can generate a sequence 23 of consecutive analog pulses 20, each of random initial height and random duration, as shown in FIG. 9, which produces a light output having the appearance of gently flickering reflection. The flicker mimics the sparkle which occurs as a gemstone is rotated under natural light. This sequence is derived from a random analog pulse generator (not shown), which is implemented in software running on the PIC microprocessor 12 and is described in greater detail hereinafter.

Figure 10:
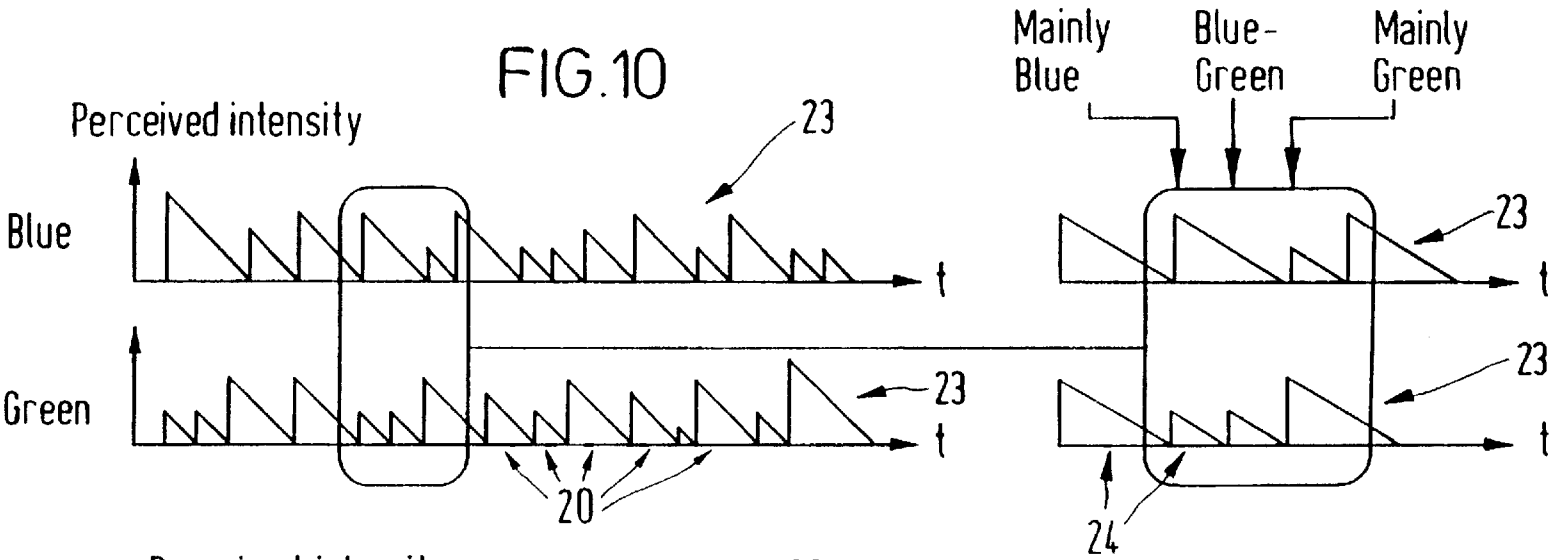
FIG. 10 is a graphical representation of perceived intensity output against time for analog pulse sequences for a blue LED and a green LED illustrating a method of simulating color variation arising from color dispersion according to the first embodiment of the present invention.

Similarly, if two simultaneous (but entirely uncorrelated) random analog pulse trains 23 are used to drive two or more adjacent LEDs 7, 8, 9 in an RGB LED cluster 6, the resulting illumination pattern appears to contain gradual shifts in color that mimic the color changes arising from the dispersion (i.e., the spectral variation of refractive index) of the gemstone material. FIG. 10 shows the principles of this effect in more detail for a blue/green LED combination. At times when the blue LED 9 is driven exclusively, the perceived color is blue. When both LEDs 8, 9 are driven at roughly equal levels, the perceived color is blue-green. Finally, when the green LED 8 is driven predominantly, the perceived color is green. In the present embodiment, all three LEDs 7, 8, 9 in an RGB cluster 6 are driven in this way by multicolor analog pulse trains 23 to provide a broad range of color output. A natural polychromatic effect is obtained using color mixes that vary only slightly from white, rather than mixes that include unnatural occurrences of pure red, pure green and pure blue.

Figure 11:
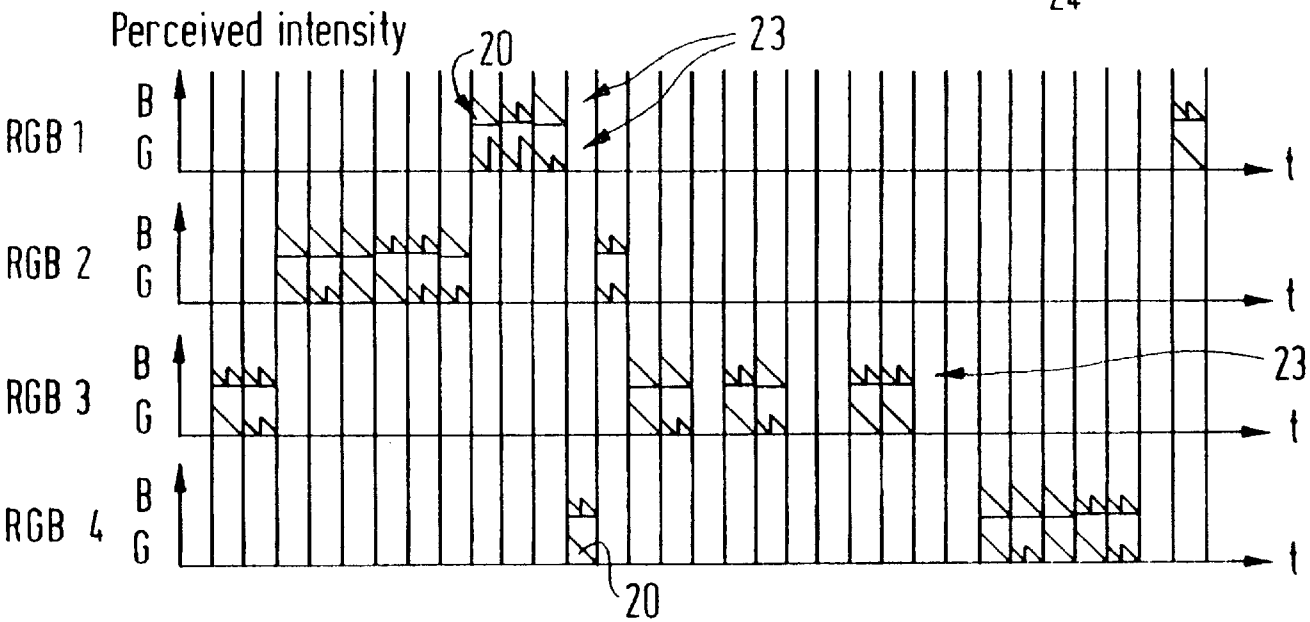
FIG. 11 is a graphical representation of perceived intensity output against time for analog pulse sequences for blue and green LEDs of an array of four RGB LED packages illustrating a method of simulating motion according to the first embodiment of the present invention.

The PIC microprocessor 12 is arranged to send the multicolor analog pulse trains 23 to one or more of the RGB LED clusters 6 in a random sequence, as shown in FIG. 11. The result simulates the effects of motion of the wearer relative to external light sources and gives the appearance of one of a number of jewels 4, 5 catching the light in turn. This pattern is analogous to the elementary binary pattern previously shown in FIG. 7. However, the major difference is that each binary monochromatic pulse of FIG. 7 is replaced by a considerably more complex analog, polychromatic pulse sequence 23 of the present embodiment.

One way of generating the complex illumination patterns described above is to generate the relevant binary sequences 21 using an off-line computer, and to downloaded the sequences to memory inside the pendant. The memory may then be read out byte-by-byte by the PIC microprocessor 12, and used to drive the LED array 4,5. The difficulty with this approach is the large memory required to store a sequence of significant duration. For example, for 8 different monochromatic LEDs modulated at 800 Hz, almost 3 MB ROM (800×3600=2,880,000) would be required to store an non-repetitive sequence lasting I hour. Although suitably large memory chips exist, their physical size makes this approach inappropriate for the present embodiment of the invention.

An alternative approach which is implemented in the present embodiment is for the PIC microprocessor 12 to compute the binary sequences 21 in real time. Considerably less memory is now required. However, the difficulty lies in the identification of algorithms capable of generating suitable patterns in real time. Furthermore, there is a requirement for these algorithms to be efficient, and it should be possible to code the algorithms with a sufficiently small number of instructions such that no significant additional memory is required to store the code itself.

Suitable code is generated in the present embodiment by shift register generators (SRGs-not shown) and software loops. Use of SRGs is a method of generating random numbers using simple software. The numbers lie between zero and a fixed limit $M_{max}$ set by the number of bits in the SRG.

To generate a single analog pulse 20, as shown in FIG. 8A, an SRG is first used to generate a random number $N_1$ lying in the range 0 to $N_{max}$ describing the initial height of the pulse. To improve randomness, $N_{max}$ need not be the same as the number of SRG states. For example, good results are obtained in the present embodiment by using an 8 bit SRG (255 states), defining the pulse height using only the lower nibble (4 bits). The analog pulse 20 itself is then generated by two software loops. After each pass through the outer loop, the number is decremented until it reaches zero, when the process is terminated. Within the first outer loop, a second inner loop is used to generate a consecutive sequence 21 of $N_i$ sequential ones followed by $N_{max}-N_i$ zeros, which are sent to appropriate LEDs 7, 8, 9. The LEDs 7, 8, 9 therefore receive a modulated signal of the form $N_1$ ones followed by $(N_{max}-N_1)$ zeros, then $(N_1-1)$ ones followed by $(N_{max}-N_1+1)$ zeros, then $(N_1-2)$ ones followed by $(N_{max}-N_1+2)$ zeros, and so on. This signal 21 is a pulse width modulated signal of the form previously shown in FIG. 8B.

To generate a random sequence 23 of analog pulses 20, an SRG is simply used repetitively, so that analog pulses 20 with random initial heights are generated continually. To generate the two random analog pulse sequences 23 needed to simulate the effects of bicolor dispersion, two SRGs, running asynchronously, are used. To simulate motion, a third SRG is used to select one or more of the RGB clusters 6 in a random manner.

Figure 12:
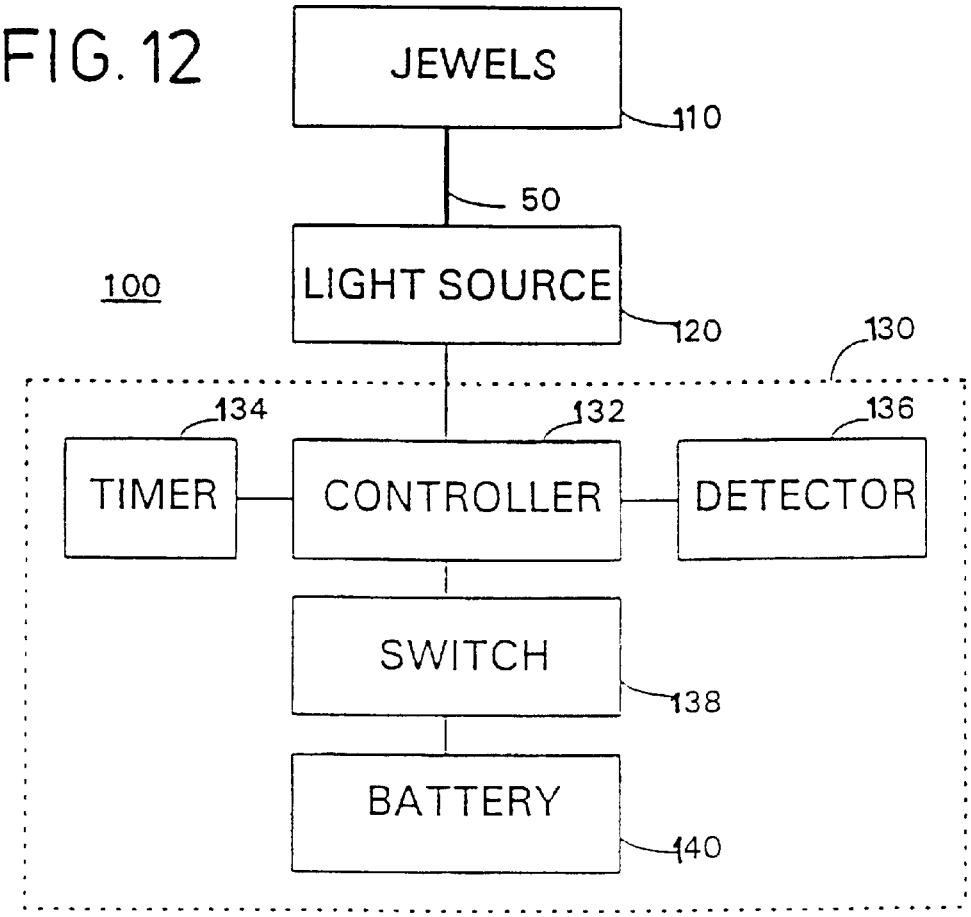
FIG. 12 is a block diagram showing an article of jewelry made according to a second embodiment of the present invention.
Figure 13:
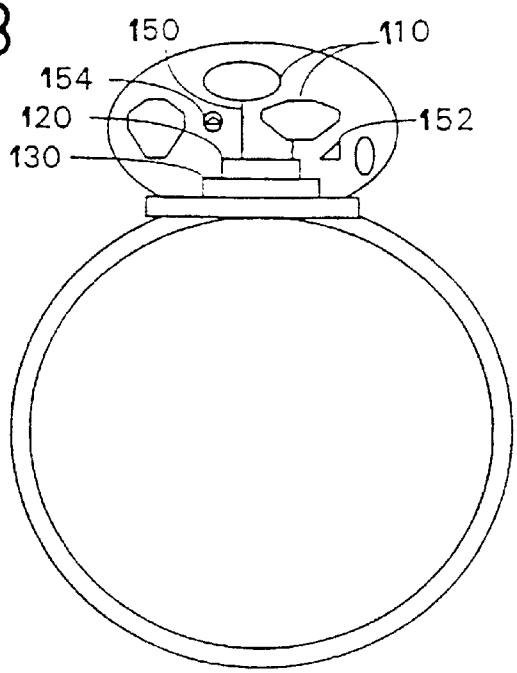
FIG. 13 is a cross-sectional diagrammatic representation of the article of jewelry shown in FIG. 12.

Referring to FIGS. 12 and 13, an article of jewelry according to a second embodiment of the present invention is shown. The article of jewelry 100 which is a ring in this embodiment, comprises a plurality of jewel stones 110 and a light source 120 incorporated in the article of jewelry 100.

Light emission from the light source 120 is controlled by an electronic system 130 which is also incorporated in the article of jewelry 100. The electronic system 130 of this embodiment comprises a controller 132, a timer 134, a detector 136, a switch 138 and a battery 140.

The control means 132 is a simple low-power microcontroller and can be the PIC microcontroller 12 of the first embodiment or an ASIC (Applications Specific Intergrated Circuit). The controller 132 is coupled to the light source 120 and controls patterns, amplitude and duration of the light emission pulses. The light pulses which are emitted are of variable intensity either by variation of the intensity along the duration of each light pulse and/or by variation of the peak light output intensity of each pulse successively along a sequence of pulses. Preferably, light pulse decay is simulated by having a succession of decreasing peak amplitude drive pulses. The basic frequency of light impulses is controlled using a signal from the timer 134. The detector 136 comprises a sensor which detects ambient temperature, ambient noise, ambient light, skin temperature and pulse rate of the wearer of the article of jewelry, or movement of the article of jewelry. It is possible to incorporate a plurality of sensors for detecting some or all of the above mentioned parameters simultaneously. In response to the detection by the detector 136, the controller 132 performs an algorithm to vary the existing pattern, amplitude and duration of the light emission pulses.

The battery 140 provides electric power to the components of the electronic system 130. The switch 138 allows the wearer of the article of jewelry to turn on or off the electronic system 130.

The jewel stones 110 and the light source 120 are linked by optical fibers 150, so that the light emitted from the light source 120 is distributed to the jewel stones 110. A mirror 152 (FIG. 18) is also incorporated in the article of jewelry 100 to reflect light emitted from the light source 120 and light reflected by the jewel stones 110 or other reflectors. In order to further stimulate scintillation of the jewel, a movable member 154 is provided which vibrates to cause variable angular deflections of light emitted from the light source 120.

FIGS. 14 to 17 illustrate third and fourth embodiments of the present invention which use a hybrid electronic module (300,400) incorporating a CMOS ASIC, an environmental sensor and an LED array. The ASIC and the LED array are coupled to an optical guiding structure for distribution of the LED outputs. In this way, a single, reconfigurable hybrid module covers a range of products, each with its own customised guiding structure.

Figure 14:
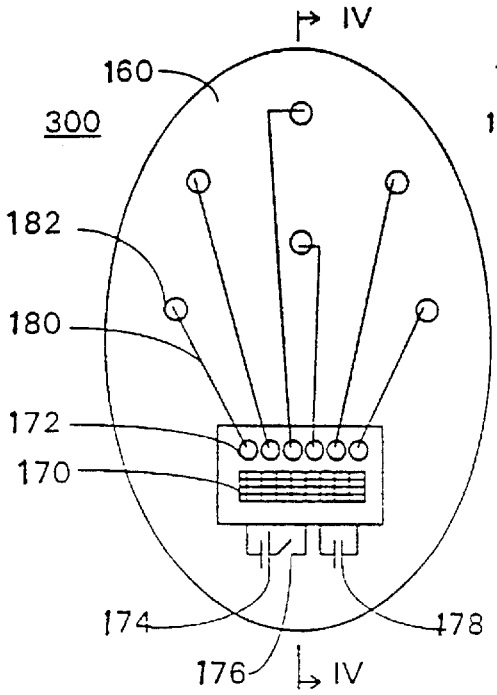
FIG. 14 is a rear view of an article of jewelry according to a third embodiment of the present invention.
Figure 15:
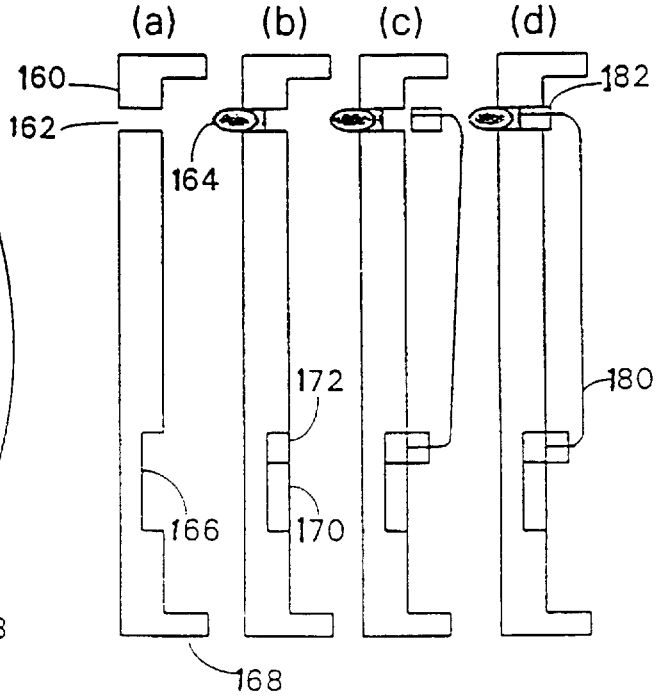
FIGS. 15(*a*)–(*d*) are cross-sectional views of the article of jewelry shown in FIG. 14.

The module 300 of the third embodiment which is shown in FIGS. 14 and 15(*a*)–(*d*) is suitable for use as part of a brooch. The module 300 uses plug connections from a light source to individual jewels using optical fibers.

FIG. 13 depicts a rear surface of a base 160 of the module 300. The base 160 is provided with throughholes 162 in which jewel stones 164 are mounted so that they can be observed from the front side of the base 160, as shown in FIGS. 15(*a*)–(*d*). The base 160 is also provided with a recess 166 on the rear surface and a flange 168 at the peripheral of the base 160. In the recess 166, an ASIC 170 and an LED array 172 are provided.

The ASIC 170 is connected to an external battery 174 via an external power switch 176 for supply of electric power to the ASIC 170. The ASIC 170 is also connected to an external timing capacitor 178 and an environmental sensor (not shown). The battery 174, the power switch 176 and the timing capacitor 178 are accommodated in a space formed by the flange 168, but they are not shown in FIG. 15 for simplicity of the drawings. The flange 168 has a shape suitable for mounting on a brooch frame and the like.

A multimode optical fiber 180 is coupled to an LED of the LED array 172 at one end and to a plug 182 at the other end. The plug 182 is inserted in the throughhole 162 from the rear surface of the base 160, as shown in FIGS. 15(*c*) and 15(*d*).

Thus, when the power switch 176 is turned on, the LED array 172 emits light according to the algorithm of the ASIC 170 using the timing capacitor 178 and with some modification in response to the detection of various environmental conditions by the environmental sensor. The light emitted from each LED of the LED array 172 is guided to the jewel stone 164 coupled to the LED via the optical fiber 180 to stimulate optical effects of the jewel stone 164.

Instead of connecting each jewel stone to an LED by a single optical fiber, two or more jewel stones may be connected by a leaky optical fiber whose metallization is partially stripped.

Figure 16:
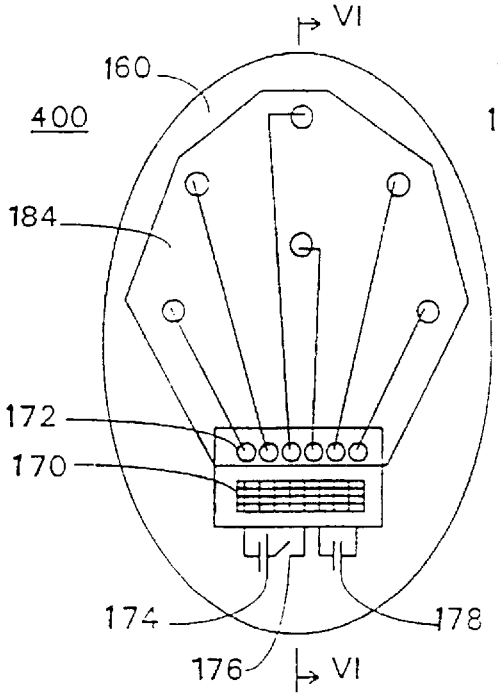
FIG. 16 is a rear view of an article of jewelry according to a fourth embodiment of the present invention.
Figure 17:
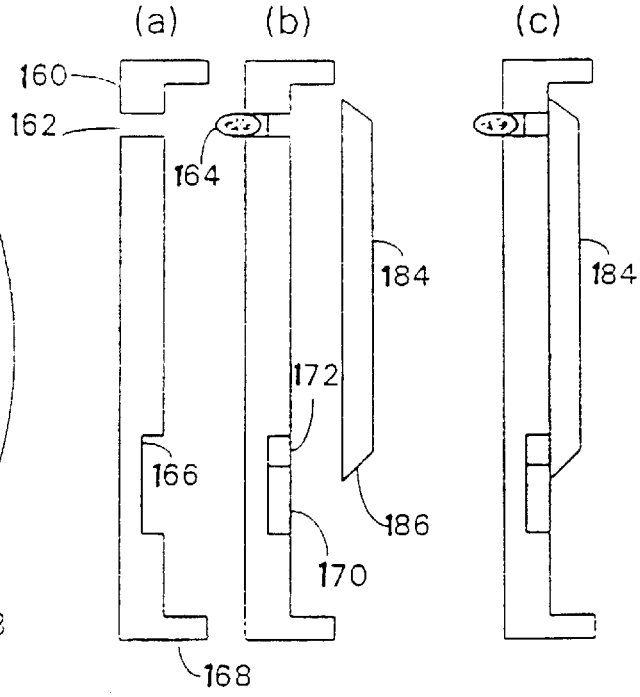
FIGS. 17(*a*)–(*c*) are cross-sectional views of the article of jewelry shown in FIG. 16.

The module 400 of the fourth embodiment, which is shown in FIGS. 16 and 17(*a*)–(*c*), differs from the module 300 shown in FIGS. 14 and 15 in its connection between the LED array 172 and the jewel stones 164. In this module 400, the LED array 172 and the jewel stones 164 are coupled by a plastic waveguide circuit 184 having a bevelled metallized edges 186 forming 45° mirrors. Thus, the connections between plural jewel stones and LEDs are made simultaneously.

Although a plurality of jewel stones are used in the first to fourth embodiments described above, a single jewel stone may be used and different parts of the jewel stone may be coupled to different light sources.

Figure 18:
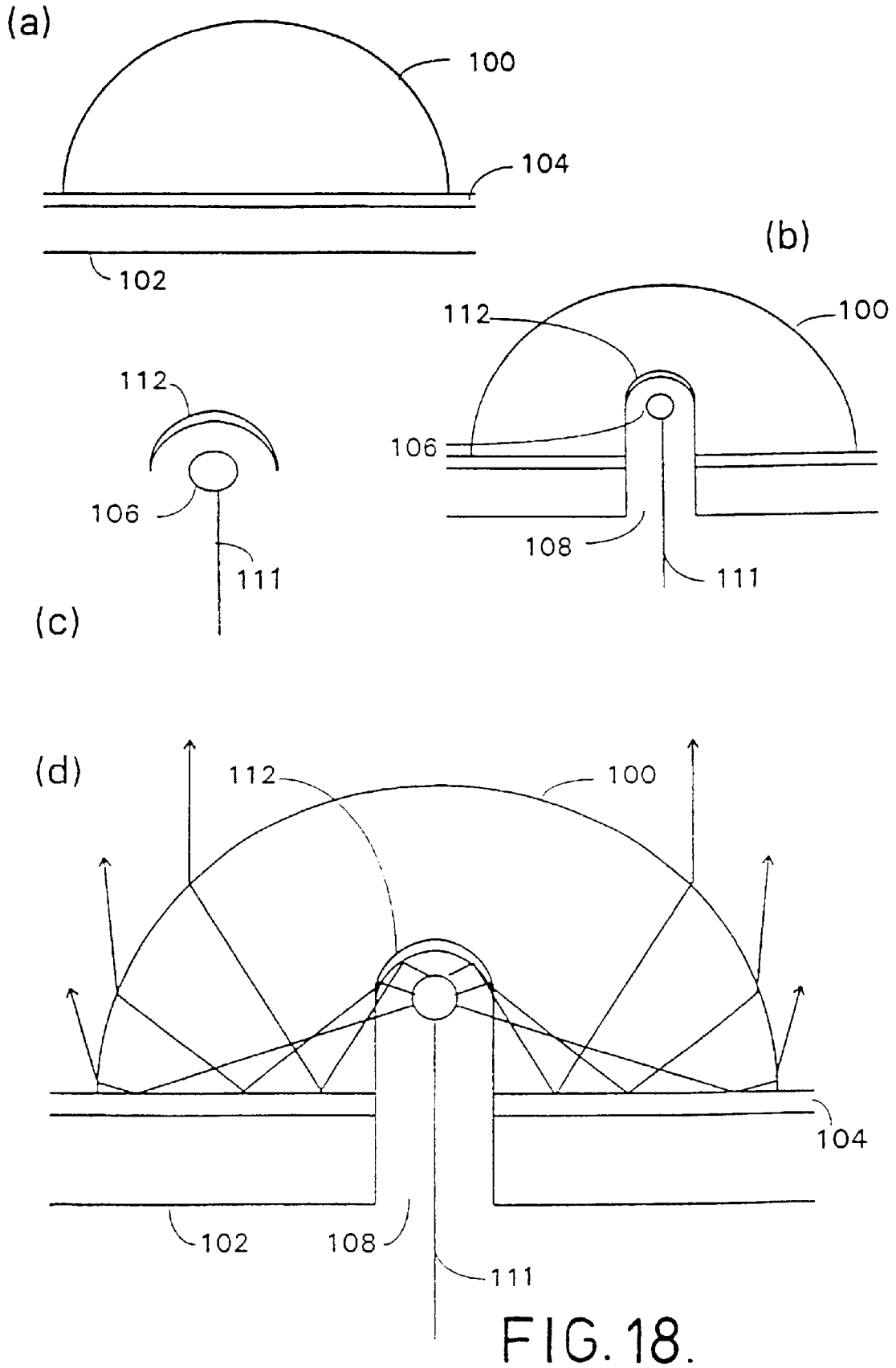
FIG. 18(*a*) is a cross sectional view of a jewel stone and a base of a prior art jewelry design.
Figure 19:
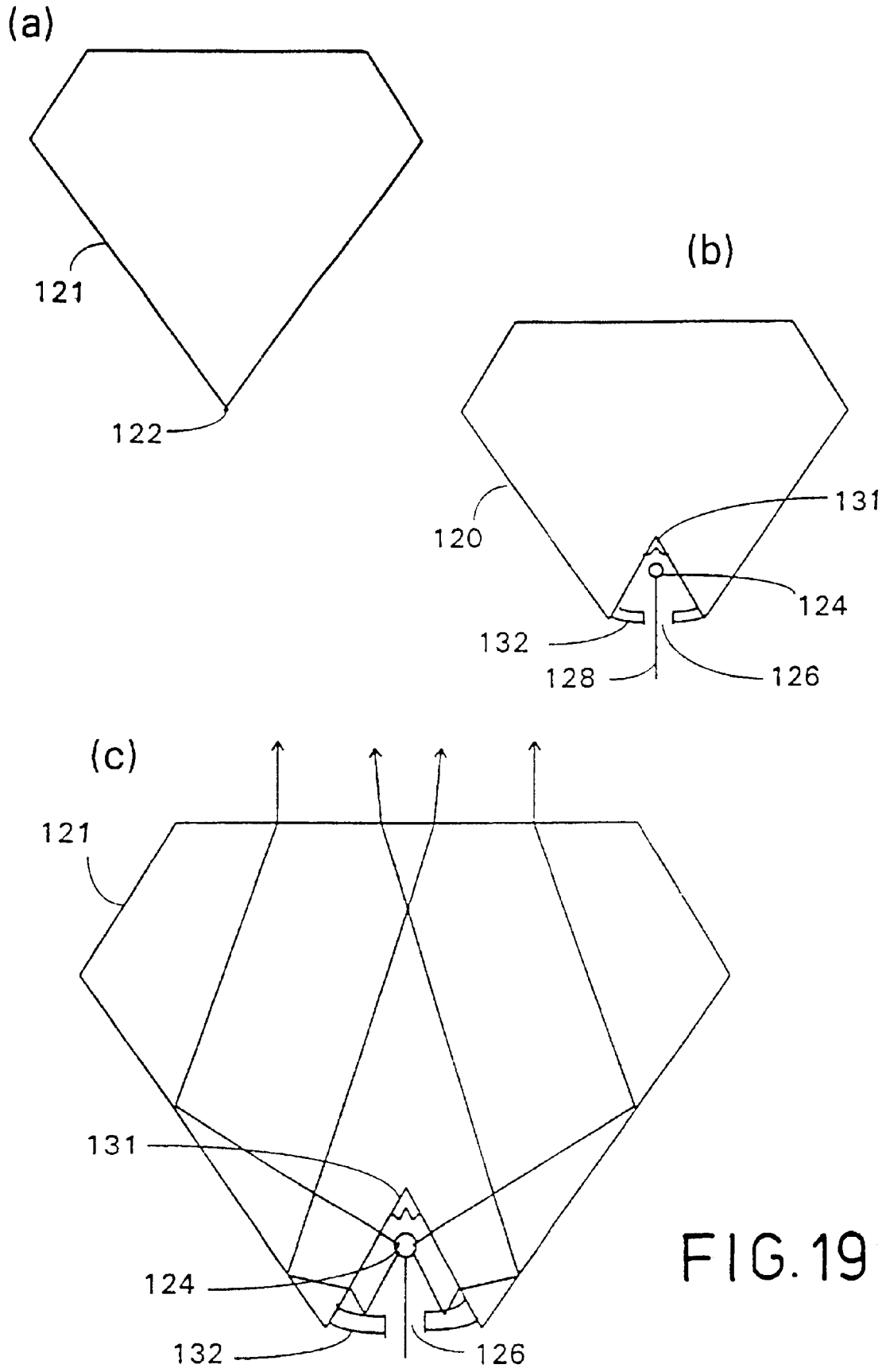
FIG. 19(*a*) is a cross sectional view of a jewel stone and a base of a prior art jewelry design.

Referring now to FIGS. 18 and 19, articles of jewelry according to a fifth and a sixth embodiment of the present invention is shown. These embodiments differ from the previous embodiments in the way that a light source is positioned with respect to the jewel stone. Otherwise, other features of the articles of jewelry are the same as that described in the second embodiment.

FIG. 18(*a*) shows a cross section of a prior art jewel stone 100 called a "cabachon" which is generally rounded spherically with a flat surface. The flat surface is mounted onto a base plate 102 which has a rhodium plated mirror surface 104 which acts as a reflector for light falling on the front of the jewel stone 100, reflecting the light back towards the eye of the viewer.

In the fifth embodiment, an LED 106 is provided within the cabachon jewel stone 100. In order to incorporate the LED 106 into the jewel stone 100, a cavity 108 is drilled through the base plate 102 and extended into the jewel stone 100, as shown in FIG. 18(*b*). The LED 106 is centered within the jewel stone 100. The LED 106 is connected to an electronic circuit (not shown) through the cavity 108 via a wire 111.

As best seen in FIG. 18(*c*), an opaque reflective coating 112 is provided at the top of the cavity 108. Thus, the direct path of light from the LED 106 to the eye of the viewer is blocked by the opaque reflective coating 112 and the light from the LED 106 is reflected back to the mirror surface 104 of the base plate 102, which then in turn re-reflects it back towards the front of the jewel stone 100, as shown in FIG. 18(*d*).

FIG. 19(*a*) depicts a standard brilliant cut jewel stone 121 having a culet 122 in cross section. The sixth embodiment of the present invention has an LED 124 provided within the standard brilliant cut jewel stone 121. As shown in FIG.

19(*b*), in order to incorporate the LED 124 into the jewel stone 121, an inverse pyramidal shaped cavity 126 is created inverting the culet 122. The creation of the cavity 126 has some effects on the appearance of the jewel stone 121 from the front, however most of the light falling on the front of the jewel stone 121 is still returned again to the front after internal reflections.

The LED 124 is inserted in the vicinity of the top of the cavity 126 and connected to an electronic circuit (not shown) through the cavity 126 via a wire 128.

When the angle of walls of the pyramidal cavity 126 is correctly chosen, there is no direct visible path (utilising refraction only and no reflection) from the LED 124 to the eye of the viewer. Any residual direct paths that do exist are blocked by the insertion of an opaque layer or mirror 131 provided at the tip of the pyramidal shaped cavity 126.

Thus, light emitted from the LED 124 enters the jewel stone 120 through the walls of the pyramidal cavity 126 and are internally reflected at least once before leaving the jewel stone 121 through the front surface, as shown in FIG. 19(*c*).

Also, a second reflective mirror 132 is incorporated at the entrance to the cavity 126, such that all light from the reverse emission of the LED 124 can be reflected back up into the jewel stone 121 to add to the light emitted directly into the jewel stone 121.

The seventh, eighth and other embodiments of the present invention, which are set out below, are based on the articles of jewelry described in the above described second embodiment. Accordingly, for the sake of avoiding unnecessary repetition, only the differences between the following embodiments and those described in the second embodiment will be described hereinafter.

Figure 20:
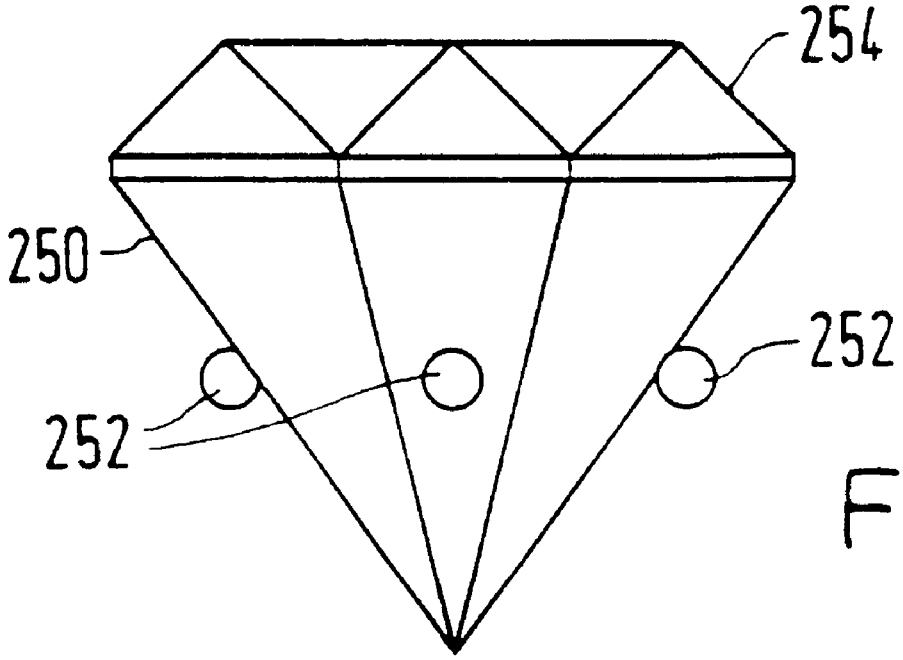
FIG. 20 is a schematic side view of a jewel stone of an article of jewelry according to a seventh and an eighth embodiment of the present invention, showing the positioning of three light sources.
Figure 21:
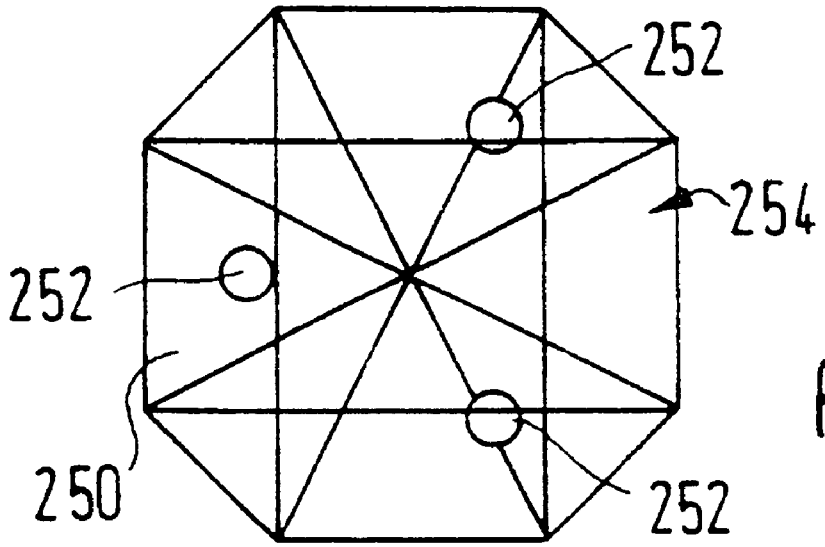
FIG. 21 is a schematic plan view of the jewel of the article of jewelry shown in FIG. 20.

Referring now to FIGS. 20 and 21, a brilliant cut jewel stone 250 of the seventh embodiment is provided with three light emitting diodes (LEDs) 252 positioned about the jewel stone 250. The LEDs 252 are arranged to direct their light output into the jewel stone 250 to cause internal reflection and refraction of the light before being output through the crown 254 of the jewel stone 250. The LEDs 252 are positioned symmetrically about the jewel stone 250 in positions such that they are not directly visible from the front (crown 254) of the jewel stone 250.

The jewel stone 250 of the seventh embodiment shown in FIGS. 21 and 22 further comprises a miniature collimating lens (not shown) provided between each LED 252 and the jewel stone 250. The collimating lenses are provided to collimate the light output of each LED 252 so as to enhance the sparkle effect in the jewel stone produced by the artificial illumination. More specifically, the output of each collimated LED 252 produces a unique spatial illumination pattern within the jewel stone 250. By selectively controlling switching between the spatial illumination patterns, the sparkle effect produced in the jewel stone 250 appears to the viewer to move.

There are several different ways in which the output of each LED 252 can be collimated. The basic requirement is to pass the light through a lens that develops a parallel beam of light instead of a divergent and random beam as can be output from a basic LED. In the present embodiment, a single miniature lens with a focal length of about 1 mm and a diameter of 1 mm is used. This lens can be formed from any transparent material, and in this embodiment is formed of glass or plastic as both work well. The lens is attached to the front of the LED assembly and the resulting collimated light beam is used to illuminate the jewel stone 250 as in previous embodiments.

Figure 22A:
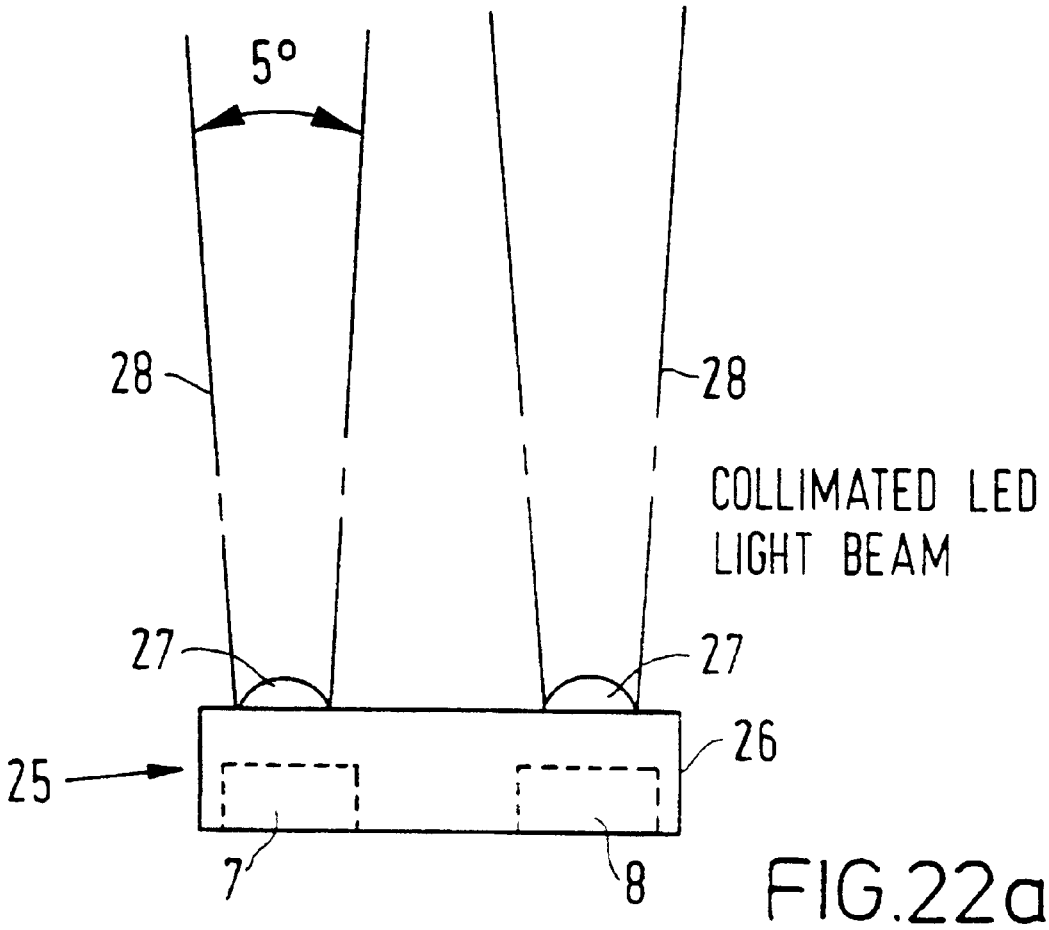
FIG. 22(*a*) is a schematic cross-sectional view of a collimated light beam package showing the degree of divergence in the light beam.
Figure 22B:
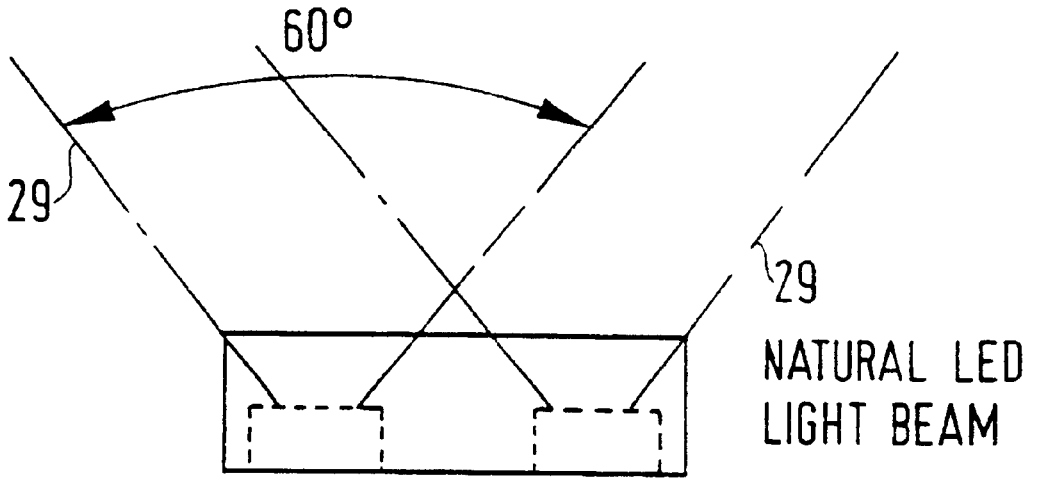
Figure 23:
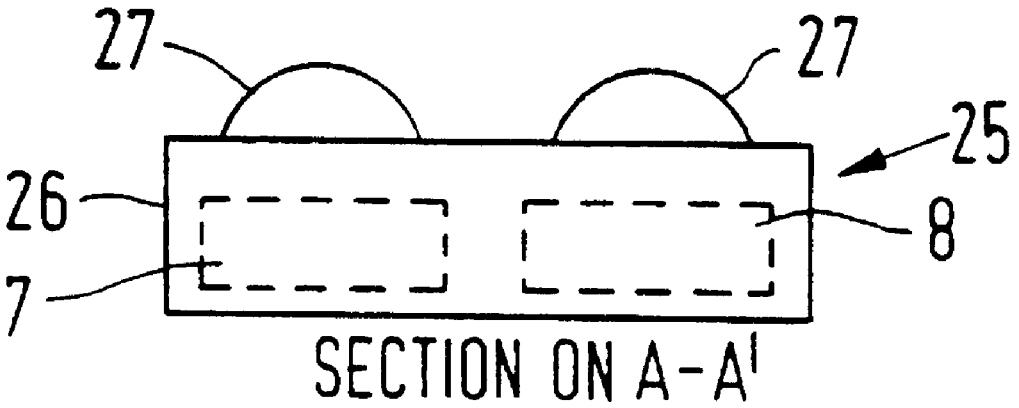
FIG. 23 is a schematic cross-sectional view of a collimated light beam package for use with the RGB LED package of the first embodiment shown in FIG. 4(*c*)
Figure 23:
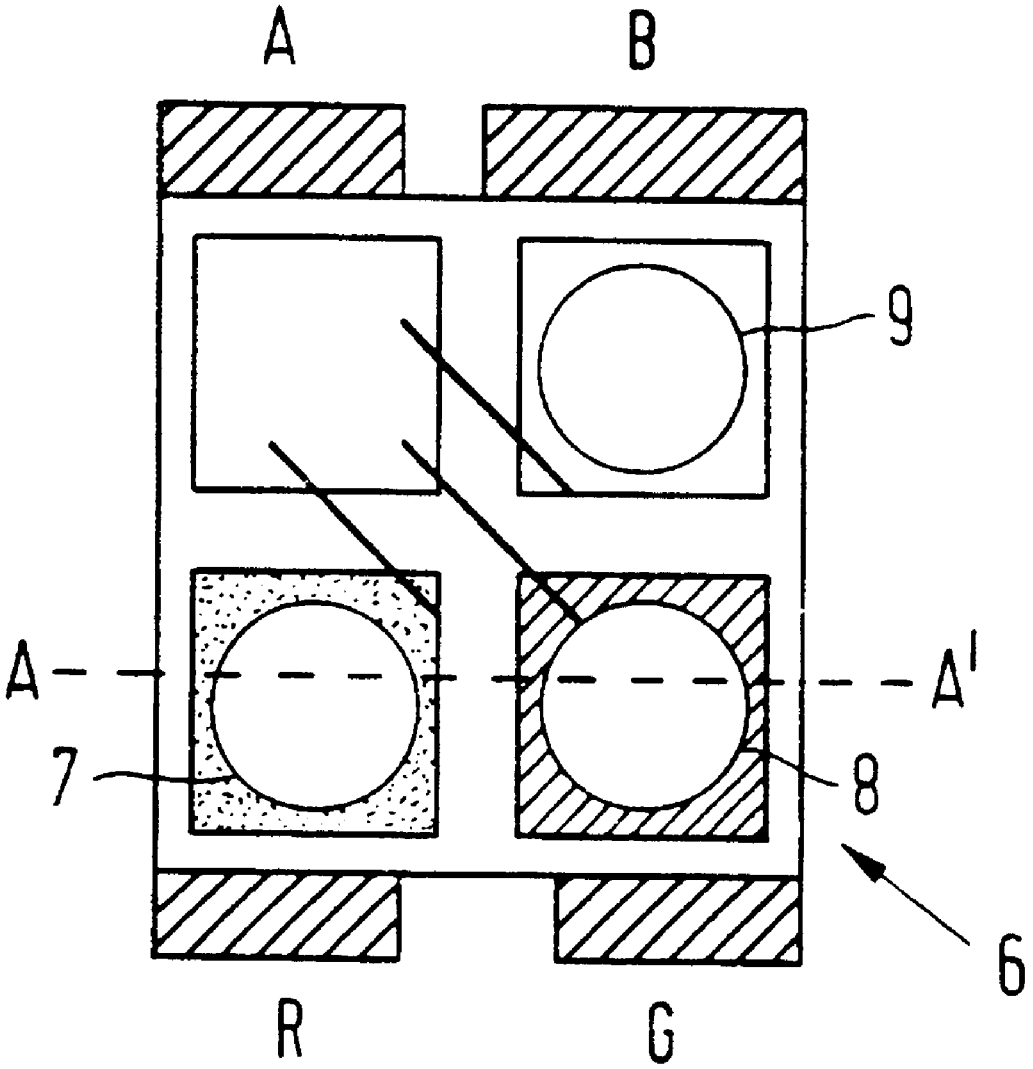

The collimated light beam concept can also be implemented with the other embodiments described herein. For example, a collimation lens package 25 which is suitable for use with the RGB LED packages 6 of the above described first embodiment, is shown in FIGS. 22*a* and 23. The lens package 25 comprises a support base 26 and three lens portions 27. The support base 26 houses the RGB LED package 6 and has each of its lens portions 27 aligned with one of the red, green and blue LEDs 7, 8, 9. The light output of each LED 7, 8, 9 is optically collimated, by virtue of a respective lens portion 27, to produce a light beam 28 having approximately 5° divergence. This can be contrasted with the non-collimated light beams 29 that would otherwise be produced which have a typical divergence angle of 60°, as shown in FIG. 22b.

Each LED 252 of the seventh embodiment is separately connected to the controller (not shown) of the electronic system (not shown) and is independently controllable. The duration or length of each light pulse emanating from each LED 252 is adjustable by the controller using the timer (not shown) of the electronic system. The LEDs 252 can be pulsed in many different ways, but in order to effectively simulate natural optical effects, the drive pulses comprise a series of varying intensity and varying time duration temporal electrical pulses.

The drive pulses are generated according to a predetermined algorithm (not shown) which not only sets the duration of each regular pulse but also determines the next LED 252 to which the drive pulse is to be sent. The selection of the next LED location is psudo-random. In this way, the stored algorithm also determines the spatial pattern of light emissions that are to be output from the article of jewelry. By varying the position of illumination of the jewel stone 250, the light reaching the viewer appears to come from different positions (different selected LEDs 252) in the jewel stone 250 which represents or simulates apparent movement.

In this embodiment, the control circuit includes a memory which can store several different algorithms. The algorithms enable the user to select the spatial illumination pattern and the regular temporal pulsing which most accurately reflects their mood. An algorithm is provided which energises each of the LEDs 252 in a sequential manner. This produces a rotational illumination effect within in the jewel stone 250 and this is particularly attractive because the jewel stone 250 of this embodiment is designed to have radial reflection and refraction elements.

The temporal pulses are generated by a random number generator (not shown) of the electronic system. A random element in the generated pulses provides an improved realistic simulation of the optical effects generated by natural illumination.

In the above described seventh embodiment, each of the LEDs 252 generates monochromatic light. However, to more accurately simulate natural optical effects, in an eighth embodiment of the present invention, each monochromatic LED 252 is replaced by a combined LED package which has three different LEDs to output three different wavelengths of light, namely red, green and blue light outputs. The packages of multi-colored LEDs produce different colored light outputs that can be generated simultaneously and in differing intensities. Accordingly, the individual light outputs can be mixed together to produce a desired colored light output which can even be close to white light. Furthermore, by blending the light output in this manner it is possible to accurately simulate the color changes caused by refraction effects seen in the jewel stone 250 when there is relative movement between the jewel stone 250 and an external light source.

Figure 24:
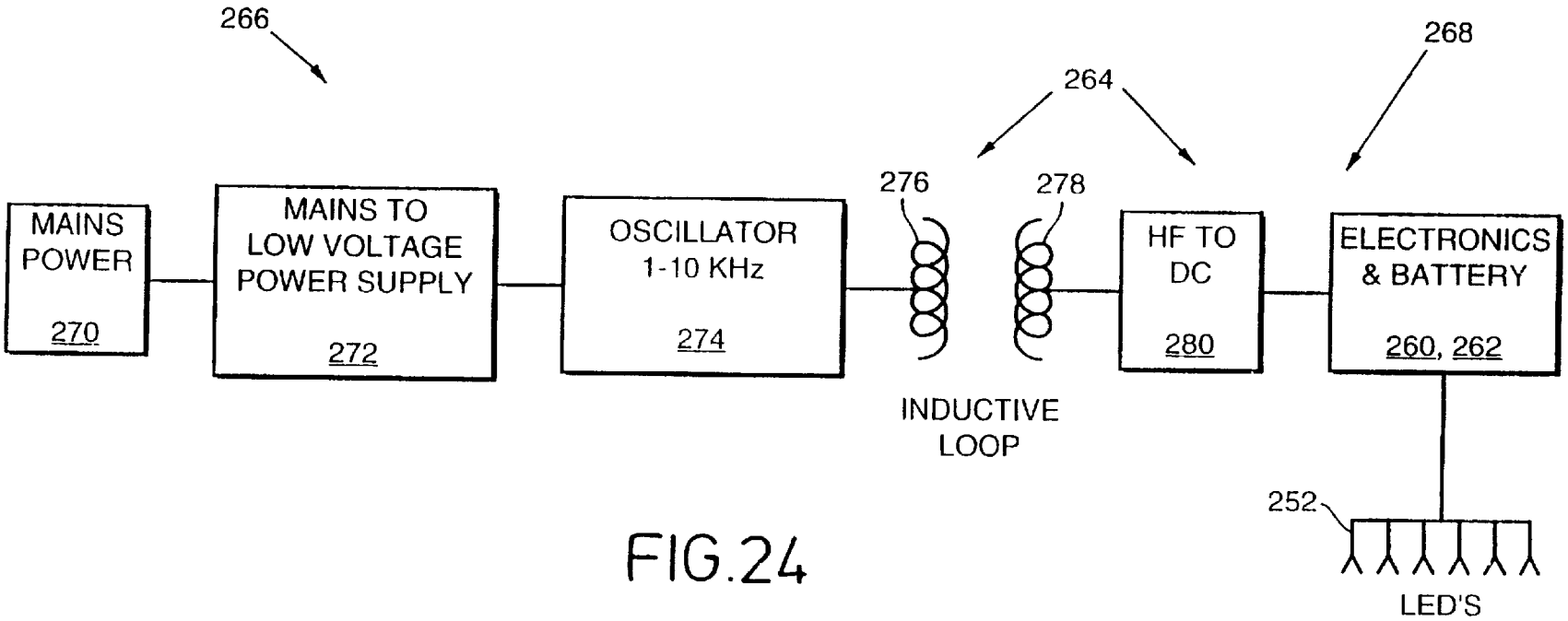
FIG. 24 is a schematic block diagram showing the components of a rechargeable power supply incorporated in the seventh and the eighth embodiments of the present invention.

Referring now to FIG. 24, the articles of jewelry described in the above seventh and eighth embodiments are each arranged to have a rechargeable power supply 260. The rechargeable power supply essentially comprises a rechargeable battery (not shown), which has a charge capacity that is enough to maintain power to the electronics 262 of the article, including the LEDs 252, for one full wearing of the article, which is typically between 5 to 10 hours.

The charging circuit 264 which recharges the battery 260, has two parts. The transmitting section 266 is connected to a permanent AC mains power supply 270 running at the conventional 240 Volts and 50 Hz, such as that of a mains supply in a house, and converts this mains power to a higher frequency transmittable power signal. The receiving section 268 receives the transmitted power signal and converts this to a constant voltage charging signal which is used the recharge the battery 260.

More particularly, the transmitting section 266 comprises a rectifying circuit 272 which converts the mains 240 Volts AC signal into a relatively low voltage DC signal, such as a 6 Volt DC signal. The low voltage DC signal is then used to power an oscillator 274. The frequency of the oscillator 274 is selectable from the range 1 KHz to 100 KHz and the selected frequency is chosen to be compatible with the dimensions of the article of jewelry. For example, for a small ring the frequency of oscillator 274 is selected to run at 10 KHz whereas for a large piece of jewelry the frequency of oscillator 274 is selected to run at 1 KHz. The output signal from the oscillator 274 is used to drive a transmitting inductor coil 276. This coil 276 can be considered to be part of a small transformer, or alternatively a transmitter coil with a very short range.

The receiving section 268 comprises a receiving inductor coil 278 which is similar to the transmitting inductor coil 276. This coil 278 is capable of receiving the power signal transmitted by the transmitting coil 276 and can be considered to be a second part of the transformer formed by the two coils 276, 278. The two coils 276, 278 make up an inductive loop circuit. The thus received signal is then converted from a relatively high frequency to a DC signal by rectifier 280. The rectified DC signal is then used to directly charge the battery 260 when the article of jewelry is not in use.

Figure 25:
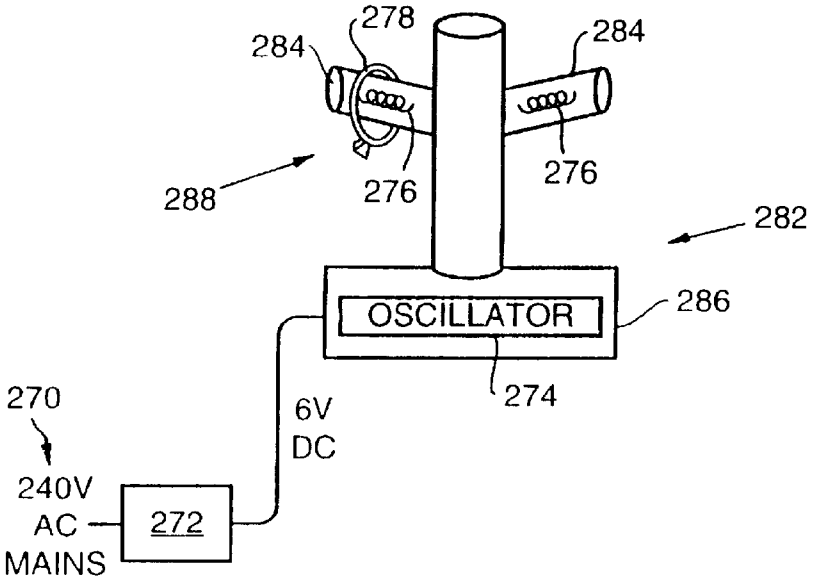
FIG. 25 is a schematic partially cut away side view of a ring tree including an external charging circuit for use with the ring shown in FIG. 13.

The transmitting section 266 of the charging circuit 264 is housed in a jewelry holder whereas the receiving section 268 of the charging circuit 264 is provided within the article of jewelry itself. One embodiment of the jewelry holder is a ring tree 282 as shown in FIG. 25 which is arranged to be used with the ring 100 of the second embodiment. The ring tree 282 has branches 284 which each house a transmitting inductor coil 276 which are connected to the oscillator 274 in the ceramic base 286 of the ring tree 282. The power to the ring tree 282 is provided from a standard mains transformer 272 which converts the AC mains voltage to a 6 volt DC power supply.

Each ring 288 (100) is recharged by simply placing the ring 288 on a branch 284 of the ring tree 282. Each ring 288 incorporates its own receiving inductance coil 278 to receive the transmitted power signal from the transmitting section 266 of the charging circuit 264. When the ring is place on the branch, the electronics 262 incorporated within the ring 288 senses the recharging process commencing and automatically switches off the electronics 262 to avoid unnecessary power consumption. This removes the need for a mechanical switch.

Figure 26:
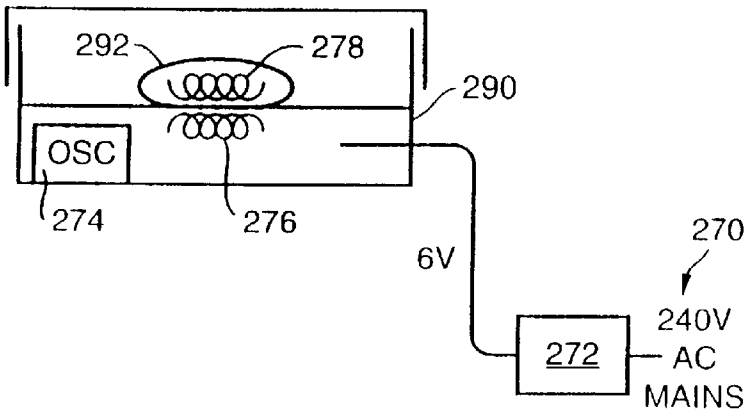
FIG. 26 is a schematic partially cut away side view of a jewelry box including an external charging circuit for use with a pendant similar to that shown in FIG. 1.
Figure 27:
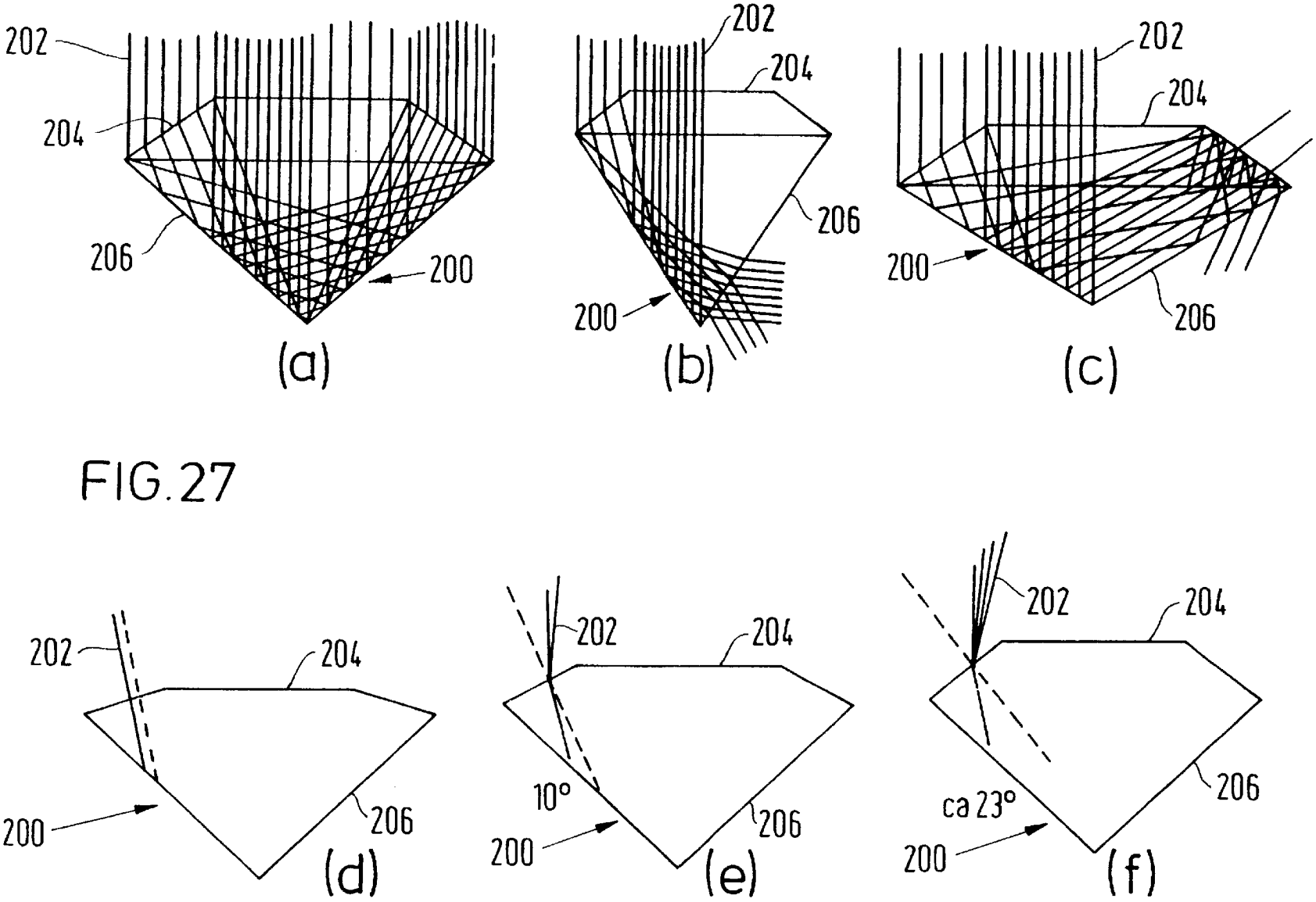
FIGS. 27(*a*)–(*f*) are cross-sectional views of jewel stones schematically showing refraction and reflection of light.
Figure 28A:
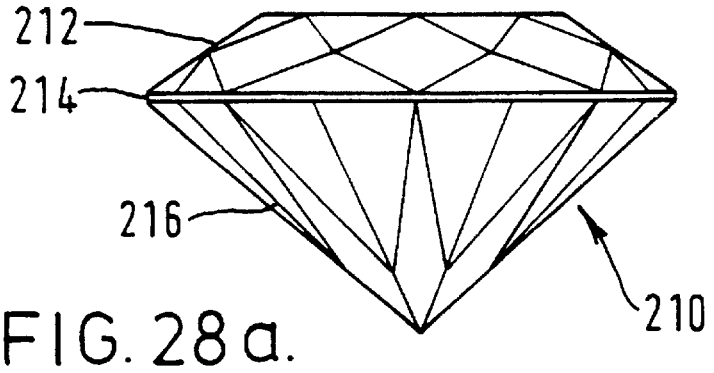
FIG. 28(*a*) is a side view of a brilliant cut jewel stone of the prior art.
Figure 28B:
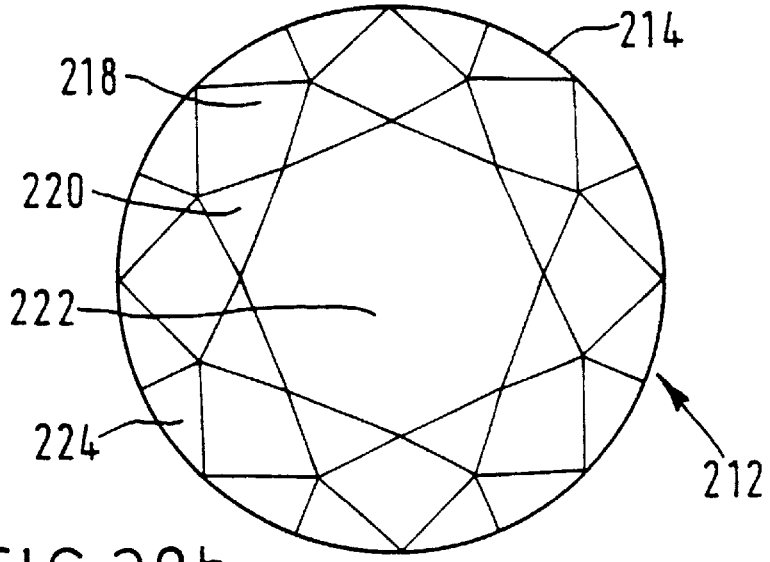
Figure 28C:
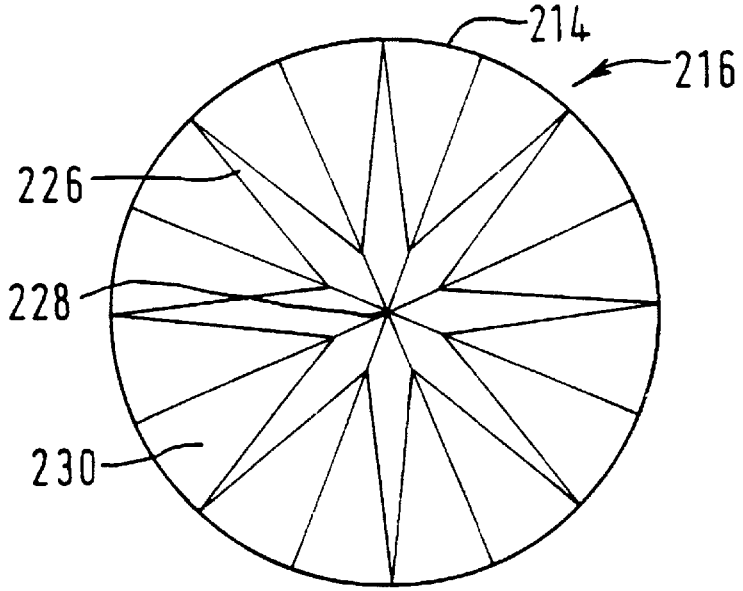
Figure 29:
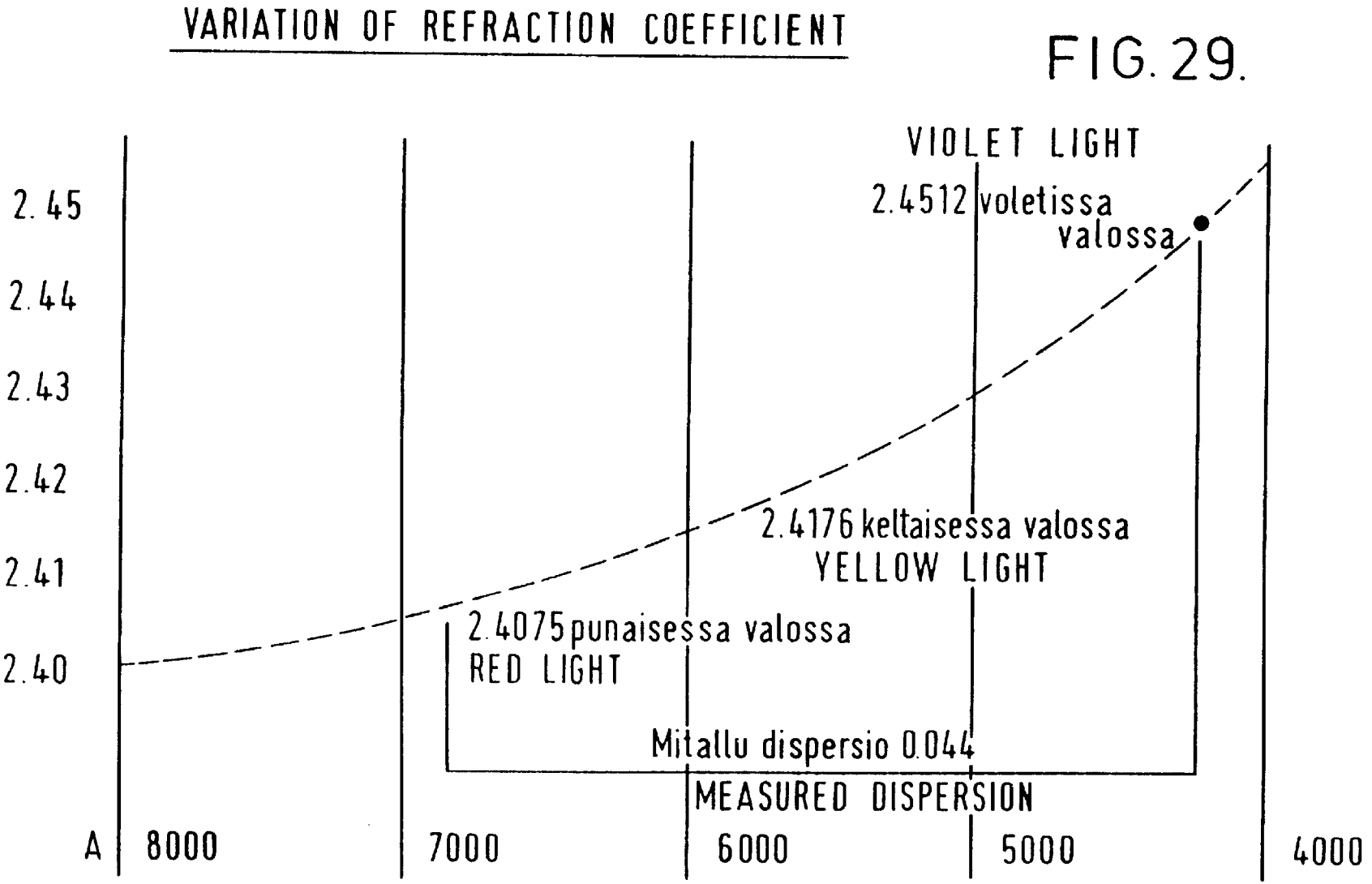
FIG. 29 is a graph showing variation of refraction coefficient for various different colors of light.

An alternative embodiment of the jewelry holder is a pendant case 290 as shown in FIG. 26 which is arranged to be used with the pendant 1 of the first embodiment of the present invention. The pendant case 290 has a base which houses both the transmitting inductor coil 276 and the oscillator 274. The power to the pendant case 290 is provided from a standard mains transformer 272 which converts the AC mains voltage to a 6 volt DC power supply. Each pendant 292 incorporates its own receiving inductance coil 278 to receive the transmitted power signal from the transmitting section 266 of the charging circuit 264 and is recharged by simply placing the pendant 292 in the case 290 adjacent the transmitting coil 276.

In some of the above described embodiments, the use of multi-colored packages have been described. These types of LED packages can be relatively expensive particularly SMD packages. A less expensive alternative is to replace the LED packages by a set of three separate LEDs each having a different color light output. One LED is positioned at each light output location to produce similar visual effects. However, the increased size of the space required to house the three separate LEDs has also to be taken into account. A less versatile but far simpler and cheaper arrangement that could also be used as an alternative, would be to provide a single different colored LED at each of the three positional locations around the jewel stone, for example one red, one green and one blue. These LEDs can be driven by the controller to effectively simulate the different colors that are seen by refraction effects within the jewel.

Figures 30A, 30B, 30C:
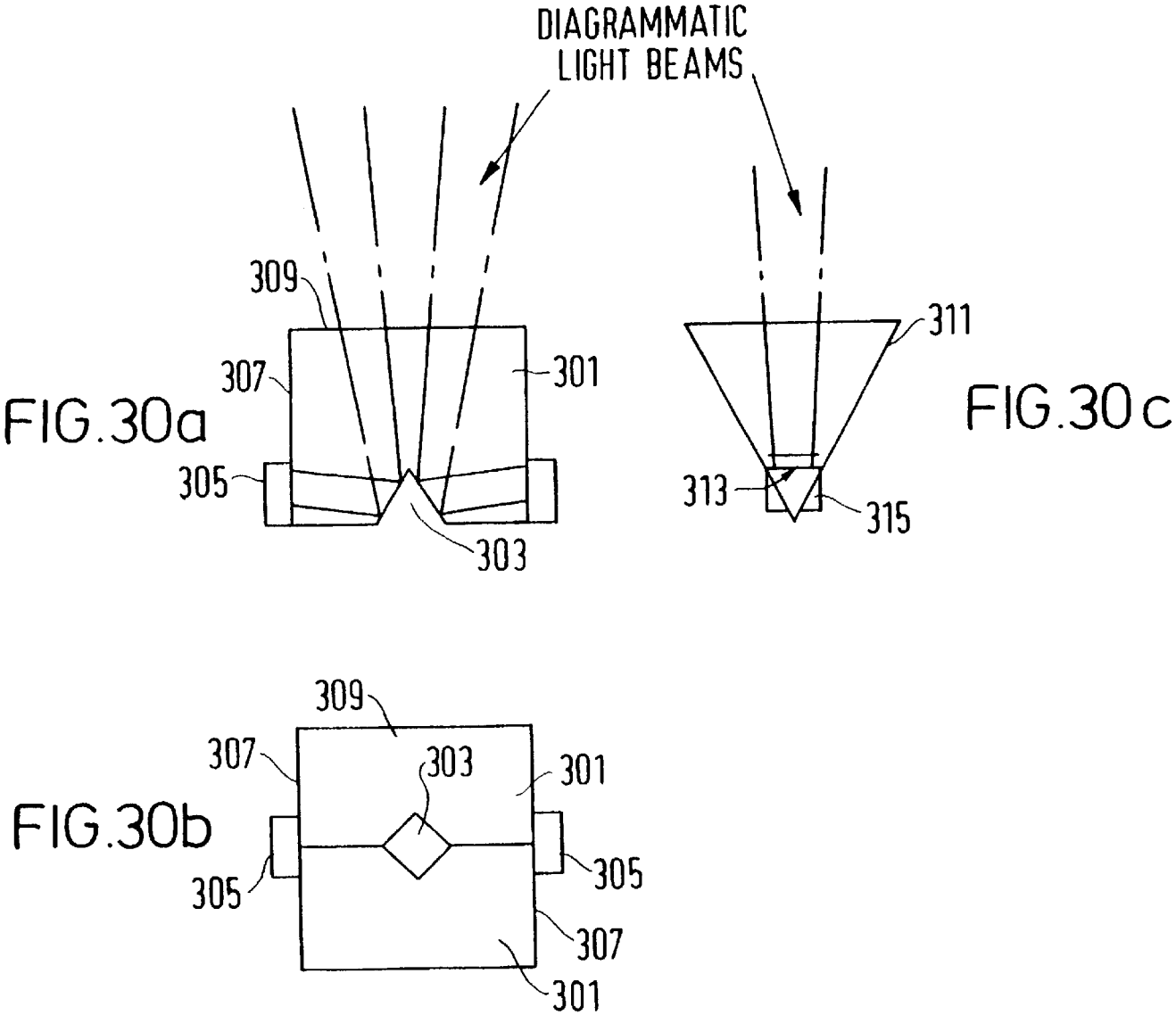
FIG. 30(*a*) is a schematic cross-sectional view of a jewel showing a special cut feature as an alternative to that shown in FIGS. 18(*b*) and 19(*b*)

In the fifth and sixth embodiments, arrangements incorporating a light source within a jewel stone cavity have been described. Two alternative arrangements are shown in FIGS. 30*a*, 30*b* and 30*c*. Referring to FIGS. 30*a* and 30*b*, a rectangular jewel stone 301 incorporates a prismatic notch 303 in its base. Two LEDs 305 are provided laterally spaced apart on the sides 307 of the jewel stone 301. The LEDs are positioned so as to direct their respective light beam paths onto the relatively inclined surfaces of the prismatic notch 303. When a light pulse from one of the LEDs hits one of the surfaces, it is reflected approximately through 90° and travels towards the eye of the viewer (not shown) through the top surface 309 of the jewel stone 301. In this embodiment as compared to the previous embodiments, a reflective surface on the rear of the jewel stone is not required and multiple light sources can readily be used in the article of jewelry.

In FIG. 30*c* shows a section through a triangular shaped jewel stone 311. An illumination LED 315 provided adjacent a prismatic notch 313 in the base of the stone 311. The notch 313 is formed as an inherent part of the stone 313 due to its triangular cross-sectional shape. This alternative embodiment works using the same principles as the alternative embodiment shown in FIGS. 30*a* and 30*b*.

In the above jewelry holder embodiments, the method of recharging the rechargeable batteries requires a source of external power generally considered to be the local mains power supply with an appropriate voltage reduction and rectification. However, in a practical application, the owner of the article of jewelry may wish to go travelling and he may be faced with difficulties if the mains voltages and/or the electrical connectors are incompatible with those required by the recharging system. Accordingly, in another embodiment of the jewelry holder, the local mains recharging system is replaced by a two-stage recharging system. The jewelry case includes a secondary rechargeable power supply having a voltage higher than the primary power supply required for the internal electronics of the illumination system, for example 4.5 Volts as compared with 3.0 Volts. The secondary rechargeable power supply has a capacity 50 to 100 times greater than the primary power supply of the illumination system. Accordingly, with this arrangement, the power supply for the illumination system is rechargeable many times by the secondary power supply before the secondary power supply requires recharging itself. Therefore a cruise, a holiday or any other situation where a compatible mains power supply may not be available, can be handled conveniently. Another practical re-charging implementation uses a small solar panel fitted to the jewel case which maintains a continuous trickle charge to the secondary re-chargeable power supply.

Having described particular preferred embodiments of the present invention, it is to be appreciated that the embodiments in question are exemplary only and that variations and modifications such as will occur to those possessed of the appropriate knowledge and skills may be made without departure from the spirit and scope of the invention as set forth in the appended claims. For example, while the present invention has been described with the objective of artificially reproducing natural optical effects such as sparkle and scintillation, it is also possible to configure the system to produce optical effects based on the same principles which do not occur in nature. There are several man-made effects, such as pulsation and ripple, which can illuminate the jewel in an attractive fashion making it more desirable to the user.

What is claimed is:

1. An article of jewelry arranged to simulate optical effects, such as sparkle, scintillation or ripple, the article comprising:

a jewel;

at least one light source incorporated in the article of jewelry for emitting light so as to illuminate the jewel; and a controller for controlling the light source to cause it to emit light pulses which are variable in intensity, thereby simulating said optical effects of the jewel.

2. An article of jewelry according to claim 1, wherein the controller is adapted to cause the light source to emit light pulses in which the light output intensity is controllably varied along the duration of each pulse.

3. An article of jewelry according to claim 2, wherein the light output intensity is decreased along the duration of each light pulse.

4. An article of jewelry according to claim 1, wherein the controller is adapted to cause the light source to emit light pulses in which the peak light output intensity is controllably varied along a sequence of light pulses.

5. An article of jewelry according to claim 1, wherein the controller is adapted to generate a series of electrical digital pulses, and to pulse width modulate the series of digital pulses to produce an analog drive signal for the light source.

6. An article of jewelry according to claim 5, wherein the controller is adapted to vary the duty ratio of the series of digital pulses so as to cause variation of the intensity of the emitted light pulses.

7. An article of jewelry according to claim 5, wherein the controller is adapted to generate the digital pulses at a modulation frequency in excess of 50 Hz.

8. An article of jewelry according to claim 5, wherein the controller comprises a microprocessor adapted to generate repetitively varying numbers of sequential electrical digital pulses over a given period of time by running iterative pulse generation loops in software.

9. An article of jewelry according to claim 1, wherein the controller is adapted to cause the light source to emit a series of light pulses in which each light pulse has a controllably variable duration.

10. An article of jewelry according to claim 1, further comprising: one or more additional light sources each being arranged to illuminate the jewel or a respective jewel; and wherein the controller is arranged to apply the electrical pulses to selected ones of said light sources.

11. An article of jewelry according to claim 10, wherein at least two of said light sources are positioned about the jewel so as to illuminate the jewel from spaced apart locations.

12. An article of jewelry according to claim 10, wherein the controller is adapted to randomly select the light source which is to be driven using a random number generator.

13. An article of jewelry according to claim 9, wherein the controller is adapted to select the duration of each light output pulse randomly using a random number generator.

14. An article of jewelry according to claim 1, wherein the controller is adapted to select the peak intensity of each light pulse randomly using a random number generator.

15. An article of jewelry according to claim 12, wherein the controller is adapted to generate the random numbers in real time.

16. An article of jewelry according to claim 10, wherein each light source is arranged to emit different colored light pulses.

17. An article of jewelry according to claim 16, wherein the controller is adapted to vary the color of the emitted light pulses by random selection of the color of the next light pulse to be emitted.

18. An article of jewelry according to claim 16, wherein each light source comprises a plurality of different colored light emitting diodes at each source location.

19. An article of jewelry according to claim 10, wherein said light sources are positioned symmetrically about the jewel and the controller is adapted to cause emission of light pulses from said light sources in a sequential manner.

20. An article of jewelry according to claim 18, wherein the controller is adapted to generate multiple sequences of pulses for driving the light sources simultaneously.

21. An article of jewelry according to claim 20, wherein the controller is adapted to cause said different colored light emitting diodes to emit multiple colored light output pulses simultaneously.

22. An article of jewelry according to claim 1, wherein the light source comprises a chemical light source which emits light by a chemically reactive process.

23. An article of jewelry according to claim 1, further comprising an optical guide for distributing light emitted from the light source to said jewel.

24. An article of jewelry according to claim 23, wherein the optical guide directs the light from the light source in a cavity provided in the jewel.

25. An article of jewelry according to claim 1, wherein the controller is adapted to cause the light source to emit light impulses which comprise basic impulses and secondary impulses.

26. An article of jewelry according to claim 1, further comprising a timer, and wherein the controller is adapted to control the basic impulses in response to a signal from the timer.

27. An article of jewelry according to claim 25, further comprising a detector which detects changes in ambient conditions and/or movement of the article of jewelry, and wherein the controller is adapted to vary the light emission from the light source in response to the detection by the detector.

28. An article of jewelry according to claim 27, wherein the detector detects one or more parameters including ambient temperature, ambient noise, ambient light, skin temperature or pulse rate of a wearer of the article of jewelry, and movement of the article of jewelry.

29. An article of jewelry according to claim 27, wherein the controller performs an algorithm to vary one or more of the pattern, amplitude, and duration of the light emission.

30. An article of jewelry according to claim 1, further comprising a reflector incorporated in the article of jewelry to reflect light emitted from the light source or light reflected by the jewel or another reflector.

31. An article of jewelry according to claim 1, further comprising a mechanical system incorporated in the article of jewelry for enhancing sparkle effects of the article of jewelry.

32. An article of jewelry according to claim 31, wherein the mechanical system comprises means for vibrating the light emitted from the light source.

33. An article of jewelry according to claim 32, wherein the vibrating means comprises a mechanical movable member.

34. An article of jewelry according to claim 33, wherein the mechanical movable member is a rotatable reflector or shutter.

35. An article of jewelry according to claim 1, wherein the jewel includes at least one of a precious stone, semi-precious stone and imitation thereof.

36. An article of jewelry according to claim 1, wherein said light source is positioned in relation to the jewel so that the light emitted from the light source is not directly visible from the front of the jewel but is internally reflected and/or refracted in the jewel at least once before reaching the eye of the viewer.

37. An article of jewelry according to claim 1, wherein the jewel is provided with a pyramidal cavity and the output of the light source is directed towards the pyramidal cavity for reflection off surfaces of the cavity.

38. An article of jewelry according to claim 1, wherein the light source is provided in a cavity provided in the jewel.

39. An article of jewelry according to claim 38, wherein the cavity is of conical or pyramidal shape and is tapered towards the inside of the jewel.

40. An article of jewelry according to claim 38, further comprising an opaque reflector provided within the cavity to block a direct path of light from the light source to a viewer.

41. An article of jewelry according to claim 38, further comprising a first reflector provided at a non-viewing side of the jewel.

42. An article of jewelry according to claim 41, further comprising a second reflector means provided at an entrance of the cavity.

43. An article of jewelry according to claim 1, further comprising means for collimating the light output from the light source into a substantially parallel beam of light.

44. An article of jewelry according to claim 43, wherein the collimating means comprises a miniature collimating lens optically coupled to said light source.

45. An article of jewelry according to claim 1, further comprising a rechargeable power supply.

46. An article of jewelry according to claim 45, further comprising means for recharging the power supply.

47. An article of jewelry according to claim 46, wherein the charging means is arranged to receive power by indirect electrical connection to an external power source.

48. An article of jewelry according to claim 46, wherein the charging means comprises an inductive loop charging circuit for receiving electrical power from a charging circuit external to said article.

49. An article of jewelry according to claim 48, wherein the inductive loop charging circuit is arranged to operate at an oscillation frequency which is proportional to the size of the article.

50. An article of jewelry according to claim 49, wherein the inductive loop charging circuit comprises means for converting a relatively high-frequency alternating current signal receivable by an inductive coil of the charging circuit to a direct current charging signal.

51. An article of jewelry according to claim 1, wherein the controller is adapted to control the light source to emit light pulses to simulate natural optical effects of the jewel.

52. An article of jewelry according to claim 1, wherein the controller is adapted to control the light source to emit light pulses to simulate man-made optical effects of the jewel.

53. A combination of an article according to claim 48, and a charging circuit external to said article, said external charging circuit being connectable to a permanent main power supply.

54. A combination of an article according to claim 53, wherein the external charging circuit transmits electrical power to said inductive loop charging circuit via an inductive loop.

55. A combination according to claim 53, wherein the external charging circuit comprises means for converting the main power supply to a low-voltage direct current power supply.

56. A combination according to claim 55, wherein the external charging circuit further comprises an oscillator for converting said low-voltage direct current power supply to a transmittable power signal.

57. A combination according to claim 56, wherein the external charging circuit further comprises an oscillator for converting said low-voltage direct current power supply to a transmittable power signal.

58. A combination according to claim 53, wherein the external charging circuit is provided in a housing in the form of a jewelry box, a jewelry ring tree, a figurine or a pedestal.

59. An article of clothing incorporating one or more articles of jewelry according to claim 1.

60. A method of illuminating a jewel for simulating optical effects of the jewel, such as sparkle, scintillation or ripple, the method comprising:

providing a light source adjacent the jewel for emitting light so as to illuminate the jewel; and controlling the light source to cause it to emit light pulses which are variable in their intensity, thereby simulating said optical effects of the jewel.

61. A system for illuminating a jewel for simulating optical effects of the jewel, such as sparkle, scintillation or ripple, the system comprising:

a light source positionable adjacent the jewel for emitting light so as to illuminate the jewel; and a controller for the light source to cause it to emit light pulses which are variable in their intensity, thereby simulating said optical effects of the jewel.

62. An object incorporating a system according to claim 61, wherein a portion of the object is illuminated by the system.

* * * * *

UNITED STATES PATENT AND TRADEMARK OFFICE

CERTIFICATE OF CORRECTION

PATENT NO. : 6,433,483 B1
DATED : August 13, 2002
INVENTOR(S) : Peter Colin Michael et al.

It is certified that error appears in the above-identified patent and that said Letters Patent is hereby corrected as shown below:

Title page,
Item [22], PCT Filed: "Nov. 12, 1999" should be -- Nov. 12, 1998 --; and Column 22,
Line 56, "claim 1" should be -- claim 25 --.

Signed and Sealed this

Eleventh Day of February, 2003

JAMES E. ROGAN
*Director of the United States Patent and Trademark Office*